US008683837B2

(12) United States Patent
Mallory et al.

(10) Patent No.: US 8,683,837 B2
(45) Date of Patent: Apr. 1, 2014

(54) METHODS OF PRESSURE FORMING METAL CONTAINERS AND THE LIKE FROM PREFORMS HAVING WALL THICKNESS GRADIENT

(75) Inventors: Robert Mallory, Kingston (CA); Yihai Shi, Loyalist Township (CA)

(73) Assignees: Novelis Inc., Atlanta, GA (US); Montebello Packaging, a division of Great Pacific Enterprises, L.P., Ontario (CA)

( * ) Notice: Subject to any disclaimer, the term of this patent is extended or adjusted under 35 U.S.C. 154(b) by 381 days.

(21) Appl. No.: 12/930,557

(22) Filed: Jan. 10, 2011

(65) Prior Publication Data

US 2011/0167886 A1 Jul. 14, 2011

Related U.S. Application Data

(60) Provisional application No. 61/335,936, filed on Jan. 12, 2010.

(51) Int. Cl.
*B21D 39/08* (2006.01)
*B21D 51/12* (2006.01)

(52) U.S. Cl.
USPC ..... 72/58; 72/61; 29/421.1

(58) Field of Classification Search
USPC ..... 72/58, 61, 62; 29/421.1
See application file for complete search history.

(56) References Cited

U.S. PATENT DOCUMENTS

| | | | | |
|---|---|---|---|---|
| 4,484,756 | A * | 11/1984 | Takamiya et al. | 280/281.1 |
| 4,485,663 | A | 12/1984 | Gold et al. | |
| 4,730,483 | A | 3/1988 | Welsh | |
| 6,802,196 | B2 | 10/2004 | Gong et al. | |
| 7,107,804 | B2 | 9/2006 | Gong et al. | |
| 2009/0113976 | A1 | 5/2009 | Tomaru et al. | |
| 2011/0062155 | A1 * | 3/2011 | Walther et al. | 220/86.2 |

FOREIGN PATENT DOCUMENTS

| | | |
|---|---|---|
| EP | 0 740 971 A1 | 11/1996 |
| GB | 577417 | 5/1946 |
| WO | WO 03/033186 A1 | 4/2003 |

OTHER PUBLICATIONS

Canadian Intellectual Property Office, International Search Report and Written Opinion (Apr. 21, 2011), Int'l Appl'n No. PCT/CA2011/000020 (Novelis).

* cited by examiner

*Primary Examiner* — Debra Sullivan
(74) *Attorney, Agent, or Firm* — Kilpartick Townsend & Stockton LLP

(57) ABSTRACT

A method of forming a bottle-shaped or other contoured metal container by providing a hollow metal preform having a closed end and a wall thickness that decreases progressively in a direction away from the closed end, and subjecting the preform to internal fluid pressure to cause the preform to expand against the wall of a die cavity defining the desired container shape. The method may be employed in pressure-ram-forming procedures wherein a punch is advanced by means of a backing ram into the die cavity to displace and deform the closed end of the preform.

40 Claims, 18 Drawing Sheets

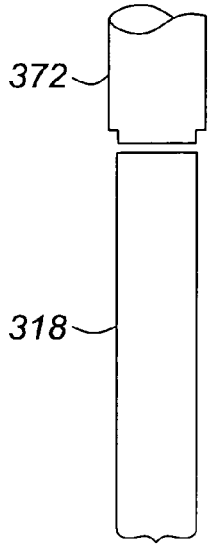
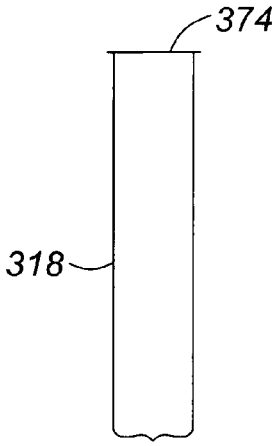
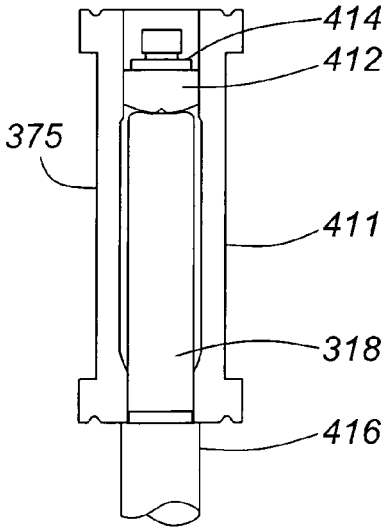
FIG. 21A FIG. 21B FIG. 22
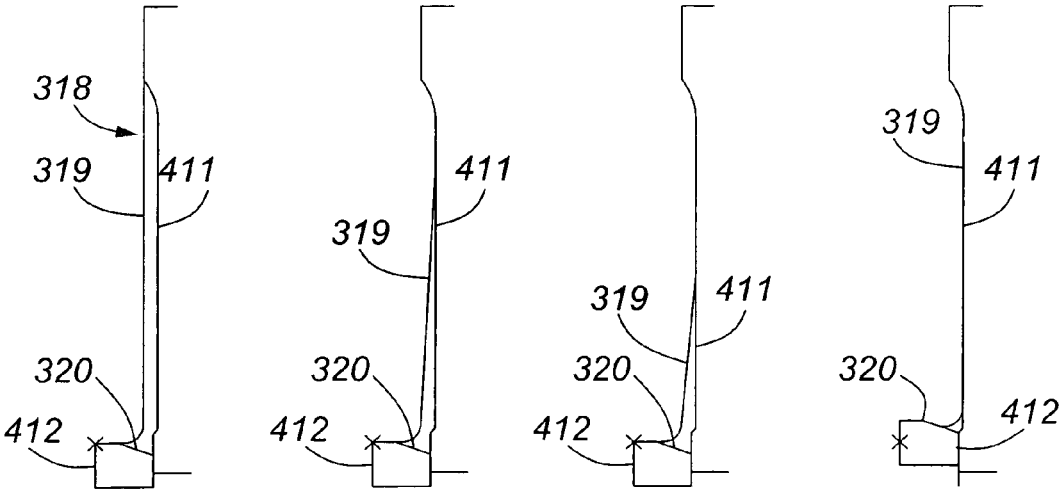
FIG.23A FIG.23B FIG.23C FIG.23D

METHODS OF PRESSURE FORMING METAL CONTAINERS AND THE LIKE FROM PREFORMS HAVING WALL THICKNESS GRADIENT

CROSS-REFERENCE TO RELATED APPLICATION

This application claims the priority right of prior U.S. provisional patent application Ser. No. 61/335,936 filed Jan. 12, 2010 by Applicants herein. The entire contents of application Ser. No. 61/335,936 are incorporated herein for all purposes by this reference.

BACKGROUND OF THE INVENTION

This invention relates to methods of producing metal containers or the like by pressure forming a hollow metal preform. In an important specific aspect, the invention is directed to methods of pressure-ram-forming aluminum or other metal containers having a contoured shape, such as a bottle shape with asymmetrical features.

Metal cans are well known and widely used for beverages. Conventional beverage can bodies generally have simple upright cylindrical side walls. It is sometimes desired, however, for reasons of aesthetics, consumer appeal and/or product identification, to impart a different and more complex shape to the side wall and/or bottom of a metal beverage container, and in particular, to provide a metal container with the shape of a bottle rather than an ordinary cylindrical can shape.

Methods have heretofore been proposed for producing such articles from hollow preforms by pressure forming, i.e., by placing the preform within a die and subjecting the preform to internal fluid pressure to expand the preform outwardly into contact with the die. As described, for example, in U.S. Pat. No. 6,802,196 and U.S. Pat. No. 7,107,804, the entire disclosures of which are incorporated herein by this reference, pressure-ram-forming (PRF) techniques provide convenient and effective methods of forming workpieces into bottle shapes or other complex shapes. Such procedures are capable of forming contoured container shapes that are not radially symmetrical, to enhance the variety of designs obtainable.

In a PRF method for forming a metal container of defined shape and lateral dimensions, a hollow metal preform having a closed end is disposed in a die cavity laterally enclosed by a die wall defining the shape and lateral dimensions, with a punch located at one end of the cavity and translatable into the cavity, the preform closed end being positioned in proximate facing relation to the punch and at least a portion of the preform being initially spaced inwardly from the die wall. The preform is subjected to internal fluid pressure to expand the preform outwardly into substantially full contact with the die wall, thereby to impart the defined shape and lateral dimensions to the preform, the fluid pressure exerting force, on the preform closed end, directed toward the aforesaid one end of the cavity. Either before or after the preform begins to expand but before expansion of the preform is complete, the punch is translated into the cavity to engage and displace the closed end of the preform in a direction opposite to the direction of force exerted by fluid pressure thereon, deforming the closed end of the preform. Translation of the punch is effected by a ram which is capable of applying sufficient force to the punch to displace and deform the preform. This method is referred to as pressure-ram-forming because the container is formed both by applied internal fluid pressure and by the translation of the punch by the ram.

The preform is a unitary workpiece typically having an open end opposite its closed end and a generally cylindrical wall. The punch has a contoured (e.g. domed) surface, and the closed end of the preform is deformed so as to conform thereto. The defined shape, in which the container is formed, may be a bottle shape including a neck portion and a body portion larger in lateral dimensions than the neck portion, the die cavity having a long axis, the preform having a long axis and being disposed substantially coaxially within the cavity, and the punch being translatable along the long axis of the cavity.

Also, advantageously and preferably, the die wall comprises a split die separable for removal of the formed container, i.e., a die made up of two or more mating segments around the periphery of the die cavity. With a split die, the defined shape may be asymmetric about the long axis of the cavity.

The PRF operation is desirably performed with the preform at an elevated temperature. In addition, it has heretofore been proposed to induce a temperature gradient in the preform, for example by adding separate heaters for inducing a temperature gradient in the preform from the open end to the closed end. Such a temperature gradient in the preform helps control the onset of preform expansion (bulging) when internal fluid pressure is applied to the preform within the die. Specifically, an open-to-closed end pressure gradient causes progressive expansion wherein the portion of the preform adjacent the open end, being at a relatively higher temperature, bulges out first until it comes into contact with the die, thus locking the preform in the die cavity as expansion moves toward the closed end, while the backing ram pushes the punch toward and holds contact with the closed end of the preform to form the closed end (container base) profile. In particular, progressive expansion prevents blow-outs by allowing the ram to move the punch into contact with the closed end and form the container base before the adjacent part of the preform engages the die wall.

It is difficult to control a temperature gradient in the preform, however, because the gradient can be adversely affected by variables such as production speed, preform size and tooling set-up. Thus, it would be advantageous to achieve the benefits of progressive expansion from open end to closed end without the necessity of establishing and maintaining a temperature gradient effective for that purpose.

SUMMARY OF THE INVENTION

In particular embodiments, the present invention embraces methods of forming a hollow metal article such as a container of defined shape and lateral dimensions, comprising the steps of disposing a hollow metal preform having a wall, a closed end and an open end in a die cavity laterally enclosed by a die wall defining the aforesaid shape and lateral dimensions, the preform closed end being positioned in facing relation to one end of the cavity and at least a portion of the preform being initially spaced inwardly from the die wall, and subjecting the preform to internal fluid pressure to expand the preform outwardly into substantially full contact with the die wall, thereby to impart the defined shape and lateral dimensions to the preform, the fluid pressure exerting force, on the closed end, directed toward the aforesaid one end of the cavity, wherein the preform as disposed in the die cavity has a wall thickness gradient such that the preform wall thickness decreases progressively from the closed end toward the open end.

The present invention in an important aspect broadly contemplates the provision of a method of forming a metal container of defined shape and lateral dimensions, comprising disposing a hollow metal preform having a wall, a closed end and an open end in a die cavity laterally enclosed by a die wall defining that shape and lateral dimensions, with a punch located at one end of the cavity and translatable into the cavity, the preform closed end being positioned in proximate facing relation to the punch and at least a portion of the preform being initially spaced inwardly from the die wall; subjecting the preform to internal fluid pressure to expand the preform outwardly into substantially full contact with the die wall, thereby to impart the aforesaid defined shape and lateral dimensions to the preform, the fluid pressure exerting force, on the closed end, directed toward the one end of the cavity; and translating the punch into the cavity to engage and displace the closed end of the preform in a direction opposite to the direction of force exerted by fluid pressure thereon, deforming the closed end of the preform, wherein the preform as disposed in the die cavity has a wall thickness gradient such that the preform wall thickness decreases progressively from the closed end toward the open end of the preform.

The method may include an initial step of providing a hollow metal preform having a wall, a closed end, an open end and a wall thickness gradient such that the preform wall thickness decreases progressively from the closed end toward the open end of the preform. In particular embodiments, the preform can be produced by drawing and ironing a sheet metal blank, with ironing performed using a tapered punch that causes the preform wall to become progressively thinner toward the open end of the preform.

Owing to the wall thickness gradient, when the preform is subjected to internal fluid pressure, outward expansion starts at its open end and moves down to its closed end; i.e., the portion of the preform at the open end bulges out first because its wall is relatively thinner than the wall at the closed end. This is essentially the same effect of progressive expansion that is achieved by heating a preform of constant wall thickness in the die cavity to induce an open-end-to-closed-end temperature gradient, but avoids the difficulties associated with a temperature gradient. In other words, the preform wall thickness gradient is preferably such that during the step of subjecting the preform to internal fluid pressure, outward expansion of the preform begins at a region adjacent to the open end, where the preform wall thickness is smallest, and progresses in a direction toward the closed end, where the wall thickness is greatest.

The preform wall thickness gradient affords other benefits as well. Although the wall gauge of the produced container is thinner than that of the preform from which it is formed, the gradient tends to be preserved, especially in straight-walled containers, with the result that the container has a relatively stronger, thicker bottom portion (as desired to help the typically domed bottom resist internal pressures e.g. from an aerosol product) and a relatively thinner top portion (as desired for ease of forming into a flange or curl as needed for a closure).

While a temperature gradient is preferably not provided in the PRF method of the present invention, general heating of the preform before and/or during the forming operation is beneficial, especially to increase the amount of total side wall expansion that is possible without causing a rupture.

Further features and advantages of the invention will be apparent from the detailed description hereinafter set forth, together with the accompanying drawings.

BRIEF DESCRIPTION OF THE DRAWINGS

FIGS. 21A and 21B are simplified schematic side elevational views in illustration of the operation of flanging a preform such as that of FIG. 20 before the preform is subjected to pressure-ram-forming;

FIG. 22 is a schematic elevational sectional view of a pressure-ram-forming die or mold cavity;

FIGS. 23A, 23B, 23C and 23D are computer-generated schematic elevational views of successive stages in an embodiment of the method of the invention.

DETAILED DESCRIPTION

By way of illustration, but without limitation, the invention will be described as embodied in methods of forming aluminum containers having a contoured shape that need not be axisymmetric (radially symmetrical about a geometric axis of the container) using a combination of hydro (internal fluid pressure) and punch forming, i.e., a PRF procedure. The term "aluminum" herein refers to aluminum-based alloys as well as pure aluminum metal.

As hereinafter explained, important features of the present invention are embodied in particular modifications in and improvements of PRF procedures, relating in particular to the production and structural features of the preform which is subjected to the PRF operation. Preforms made and configured in accordance with the invention may be subjected to diverse PRF procedures of types set forth, for example, in the aforementioned U.S. Pat. No. 6,802,196 and U.S. Pat. No. 7,107,804, and the latter procedures, when applied to those preforms, constitute embodiments of the method of the present invention.

Accordingly, the following description will begin with an overview of PRF procedures disclosed in the aforementioned U.S. Pat. No. 6,802,196 and No. 7,107,804. The particular features of the present invention will then be described.

PRF Overview

As described in the aforementioned U.S. Pat. No. 6,802,196 and No. 7,107,804, the PRF manufacturing procedure has two distinct stages, the making of a preform and the subsequent forming of the preform into the final container. There are several options for the complete forming path and the appropriate choice is determined by the formability of the aluminum sheet being used.

The preform is made from aluminum sheet having a recrystallized or recovered microstructure and with a gauge, for example, in the range of 0.25 mm to 1.5 mm. The preform is a closed-end cylinder that can be made by, for example, a draw-redraw process.

The diameter of the preform lies somewhere between the minimum and maximum diameters of the desired container product. Threads may be formed on the preform prior to the subsequent forming operations. The profile of the closed end of the preform may be designed to assist with the forming of the bottom profile of the final product.

Figure 1:
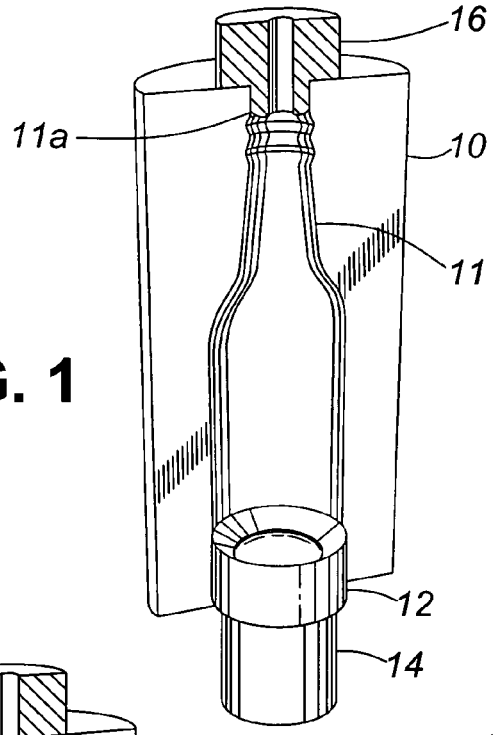
FIG. 1 is a simplified and somewhat schematic perspective view of tooling for pressure-ram-forming.

As illustrated in FIG. 1, a tooling assembly for a PRF method includes a split die 10 with a profiled cavity 11 defining an axially vertical bottle shape, a punch 12 that has the contour desired for the bottom of the container (for example, in the illustrated embodiments, a convexly domed contour for imparting a domed shape to the bottom of the formed container) and a ram 14 that is attached to the punch. In FIG. 1, only one of the two halves of the split die is shown, the other being a mirror image of the illustrated die half; as will be apparent, the two halves meet in a plane containing the geometric axis of the bottle shape defined by the wall of the die cavity 11.

The minimum diameter of the die cavity 11, at the upper open end 11*a* thereof (which corresponds to the neck of the bottle shape of the cavity) is equal to the outside diameter of the preform (see FIG. 2A) to be placed in the cavity, with allowance for clearance. The preform is initially positioned slightly above the punch 12 and has a schematically represented pressure fitting 16 at the open end 11*a* to allow for internal pressurization. Pressurization can be achieved, for example, by a coupling to threads formed in the upper open end of the preform, or by inserting a tube into the open end of the preform and making a seal by means of the split die or by some other pressure fitting.

The pressurizing step involves introducing, to the interior of the hollow preform, a fluid such as water or air under pressure sufficient to cause the preform to expand within the cavity until the wall of the preform is pressed substantially fully against the cavity-defining die wall, thereby imparting the shape and lateral dimensions of the cavity to the expanded preform. Stated generally, the fluid employed may be compressible or noncompressible, with any of mass, flux, volume or pressure controlled to control the pressure to which the preform walls are thereby subjected. In selecting the fluid, it is necessary to take into account the temperature conditions to be employed in the forming operation; if water is the fluid, for example, the temperature must be less than 100° C., and if a higher temperature is required, the fluid should be a gas such as air, or a liquid that does not boil at the temperature of the forming operation.

As a result of the pressurizing step, detailed relief features formed in the die wall are reproduced in inverse mirror-image form on the surface of the resultant container. Even if such features, or the overall shape, of the produced container are not axisymmetric, the container is removed from the tooling without difficulty owing to the use of a split die.

Figure 2A:
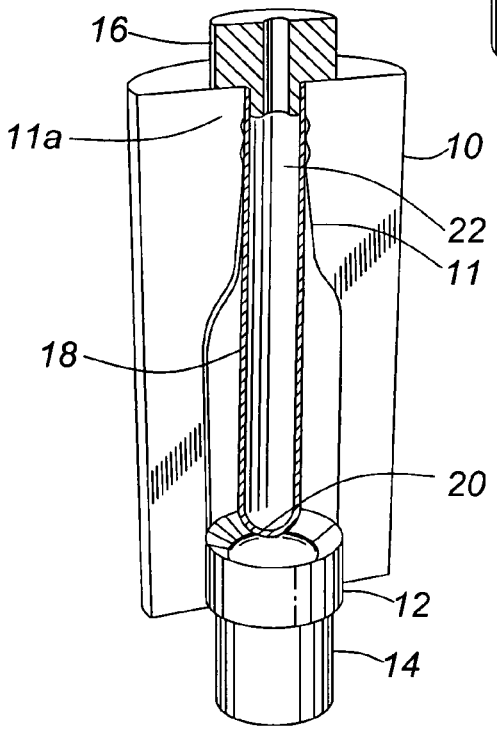
FIGS. 2A and 2B are views similar to FIG. 1 of sequential stages in the performance of a PRF method.
Figure 2B:
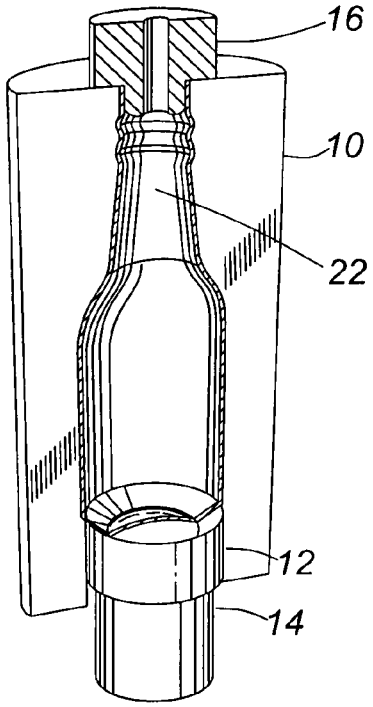

In the specific PRF procedure illustrated in FIGS. 2A and 2B, the preform 18 is a hollow cylindrical aluminum workpiece with a closed lower end 20 and an open upper end 22, having an outside diameter equal to the outside diameter of the neck of the bottle shape to be formed, and the forming strains of the PRF operation are within the bounds set by the formability of the preform (which depends on temperature and deformation rate). With a preform having this property of formability, the shape of the die cavity 11 is made exactly as required for the final product and the product can be made in a single PRF operation. The motion of the ram 14 and the rate of internal pressurization are such as to minimize the strains of the forming operation and to produce the desired shape of the container. Neck and side-wall features result primarily from the expansion of the preform due to internal pressure, while the shape of the bottom is defined primarily by the motion of the ram and punch 12, and the contour of the punch surface facing the preform closed end 20.

Figure 3:
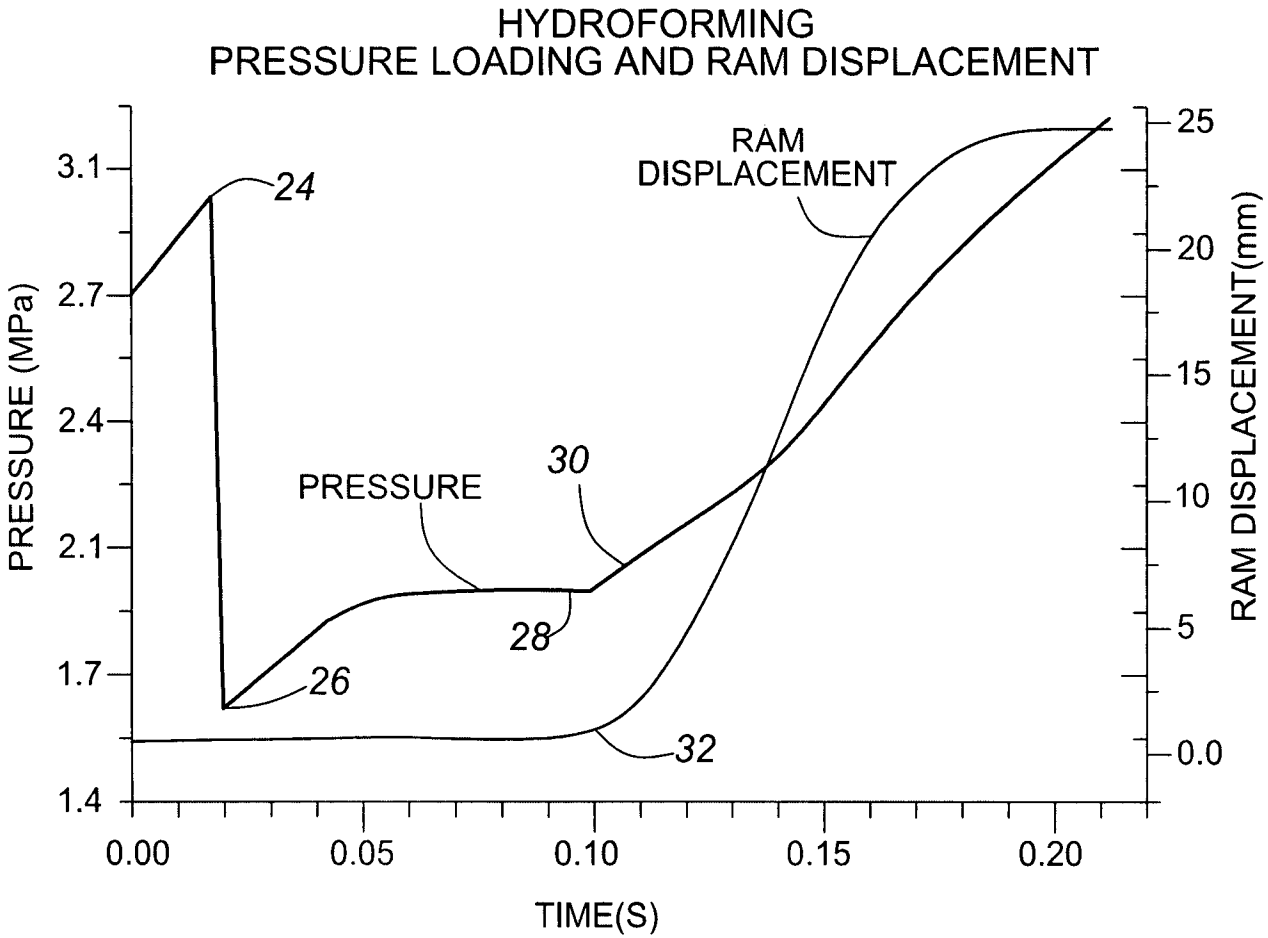
FIG. 3 is a graph of internal pressure and ram displacement as functions of time, using air as the fluid medium, illustrating the time relationship between the steps of subjecting the preform to internal fluid pressure and translating the punch in the method represented in FIGS. 2A and 2B.
Figure 4A:
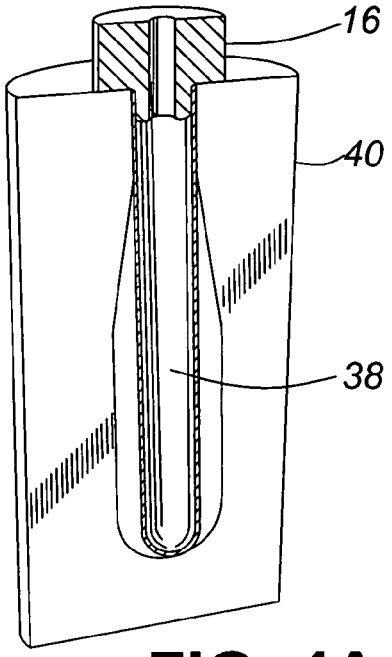
FIGS. 4A, 4B, 4C and 4D are views similar to FIG. 1 of sequential stages in the performance of a modified PRF method.
Figure 4B:
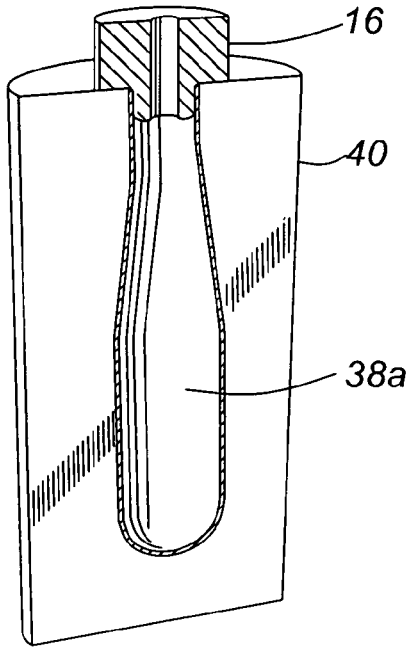
Figure 4C:
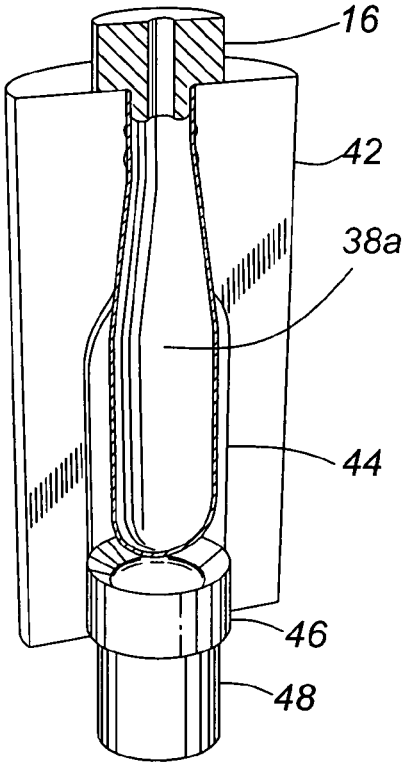
Figure 4D:
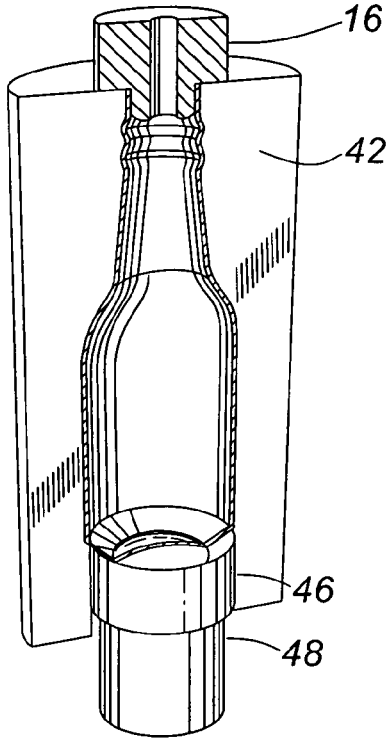

Proper synchronization of the application of internal fluid pressure and operation (translation into the die cavity) of the ram and punch are important. FIG. 3 shows a plot of computer-generated simulated data (sequence of finite element analysis outputs) representing the forming operation of FIGS. 2A and 2B with air pressure, controlled by flux. Specifically, the graph illustrates the pressure and ram time histories involved. As will be apparent from FIG. 3, the fluid pressure within the preform occurs in successive stages of (i) rising to a first peak 24 before expansion of the preform begins, (ii) dropping to a minimum value 26 as expansion commences, (iii) rising gradually to an intermediate value 28 as expansion proceeds until the preform is in extended though not complete contact with the die wall, and (iv) rising more rapidly (at 30) from the intermediate value during completion of preform expansion. Stated with reference to this sequence of pressure stages, the initiation of translation of the punch to displace and deform the closed end of the preform in preferred PRF procedures occurs (at 32) substantially at the end of stage (iii). Time, pressure and ram displacement units are indicated on the graph. The effect of the operations represented in FIG. 3 on the preform (in a computer generated simulation) is shown in FIGS. 6A, 6B, 6C and 6D for times 0.0, 0.096, 0.134 and 0.21 seconds as represented on the x-axis of FIG. 3.

At the outset of introduction of internal fluid pressure to the hollow preform, the punch 12 is disposed beneath the closed end of the preform (assuming an axially vertical orientation of the tooling, as shown) in closely proximate (e.g. touching) relation thereto, so as to limit axial stretching of the preform under the influence of the supplied internal pressure. When expansion of the preform attains a substantial though not fully complete degree, the ram 14 is actuated to forcibly translate the punch upwardly, displacing the metal of the closed end of the preform upwardly and deforming the closed end into the contour of the punch surface, as the lateral expansion of the preform by the internal pressure is completed. The upward displacement of the closed preform end, in these described procedures, does not move the preform upwardly relative to the die or cause the side wall of the preform to buckle (as might occur by premature upward operation of the ram) owing to the extent of preform expansion that has already occurred when the ram begins to drive the punch upward.

A second example of a PRF procedure is illustrated in FIGS. 4A-4D. In this example, as in that of FIGS. 2A and 2B, the cylindrical preform 38 has an initial outside diameter equal to the minimum diameter (neck) of the final product. However, in this example it is assumed that the forming strains of the PRF operation exceed the formability limits of the preform. In this case, two sequential pressure forming operations are required. The first (FIGS. 4A and 4B) does not require a ram and simply expands the preform within a simple split die 40 to a larger diameter workpiece 38*a* by internal pressurization. The second is a PRF procedure (FIGS. 4C and 4D), starts with the workpiece as initially expanded in the die 40 and, employing a split die 42 with a bottle-shaped cavity 44 and a punch 46 driven by a ram 48, i.e., using both internal pressure and the motion of the ram, produces the final desired bottle shape, including all features of the side-wall profile and the contours of the bottom, which are produced primarily by the action of the punch 46.

Figure 5A:
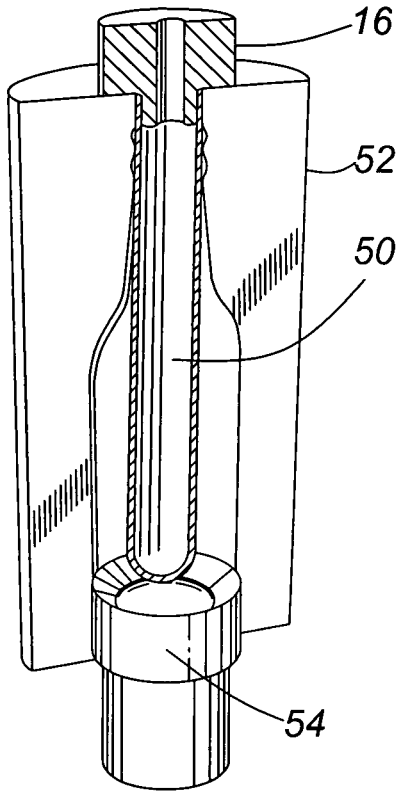
FIGS. 5A and 5B are, respectively, a view similar to FIG. 1 and a simplified, schematic perspective view of a spin-forming step, illustrating sequential stages in the performance of another modified PRF method.
Figure 5B:
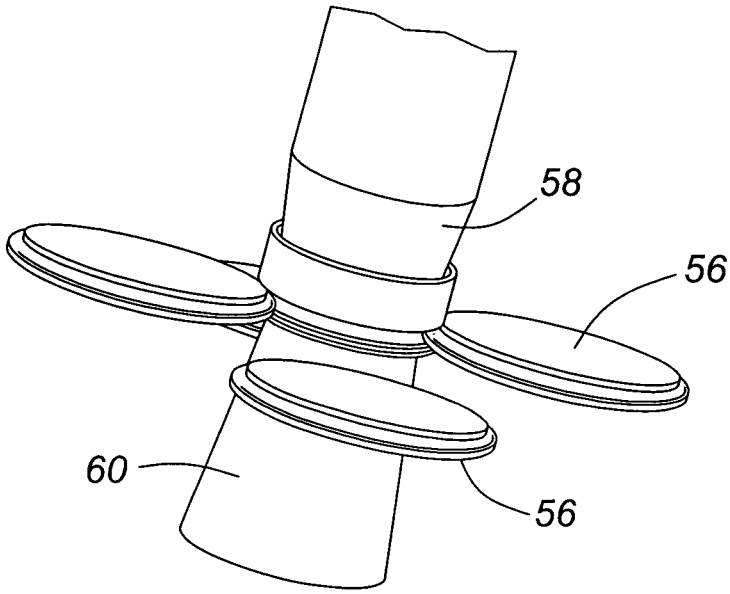

A third example of a PRF procedure is shown in FIGS. 5A and 5B. In this example, the preform 50 is made with an initial outside diameter that is greater than the desired minimum outside diameter (usually the neck diameter) of the final bottle-shaped container. This choice of preform may result from considerations of the forming limits of the pre-forming operation or may be chosen to reduce the strains in the PRF operation. In consequence, manufacture of the final product must include both diametrical expansion and compression of the preform and thus cannot be accomplished with the PRF apparatus alone. A single PRF operation (FIG. 5A, employing split die 52 and ram-driven punch 54) is used to form the wall and bottom profiles (as in the embodiment of FIGS. 2A and 2B) and a spin forming or other necking operation is required to shape the neck of the container. As illustrated in FIG. 5B, one type of spin forming procedure that may be employed is that set forth in U.S. Pat. No. 6,442,988, the entire disclosure of which is incorporated herein by this reference, utilizing plural tandem sets of spin forming discs 56 and a tapered mandrel 58 to shape the bottle neck 60.

In the practice of the PRF procedure described above, PRF strains may be large. Alloy composition is accordingly selected or adjusted to provide a combination of desired product properties and enhanced formability. If still better formability is required, the forming temperature may be increased, since an increase in temperature affords better formability; hence, the PRF operation(s) may need to be conducted at elevated temperatures and/or the preform may require a recovery anneal, in order to increase its formability.

PRF procedures could also be used to shape containers from other materials, such as steel.

The importance of moving the ram-driven punch 12 into the die cavity 11 to displace and deform the closed end 20 of the preform 18 (as in FIGS. 2A and 2B) may be further explained by reference to FIG. 3 (mentioned above) as considered together with FIGS. 6A-6D, in which the dotted line represents the vertical profile of the die cavity 11, and the displacement (in millimeters) of the dome-contoured punch 12 at various times after the initiation of internal pressure is represented by the scale on the right-hand side of that dotted line.

Figure 6A:
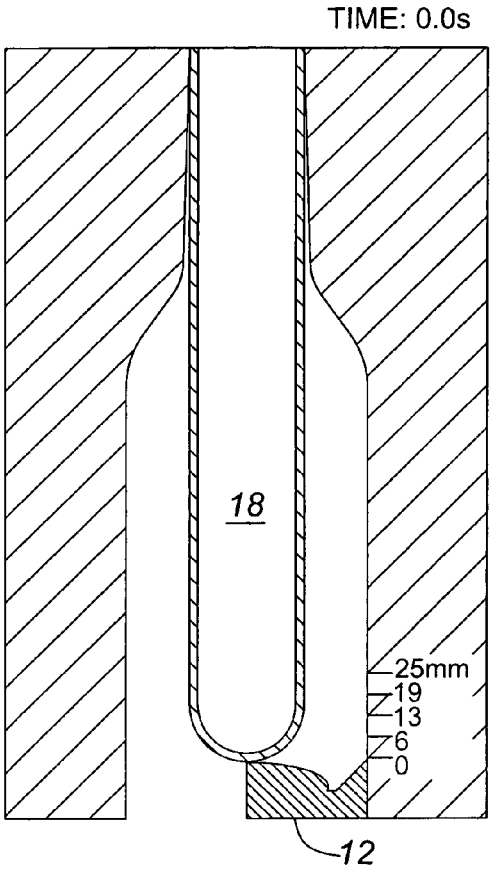
FIGS. 6A, 6B, 6C and 6D are computer-generated schematic elevational views of successive stages in a PRF method.
Figure 6B:
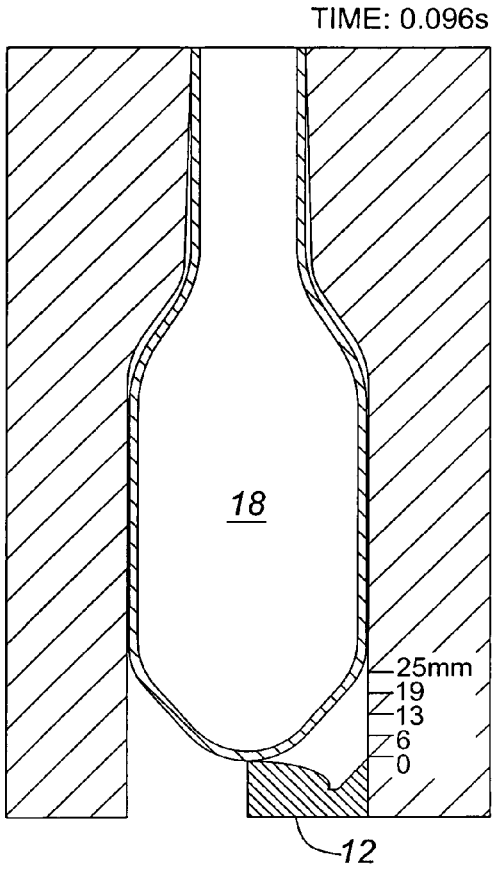
Figure 6C:
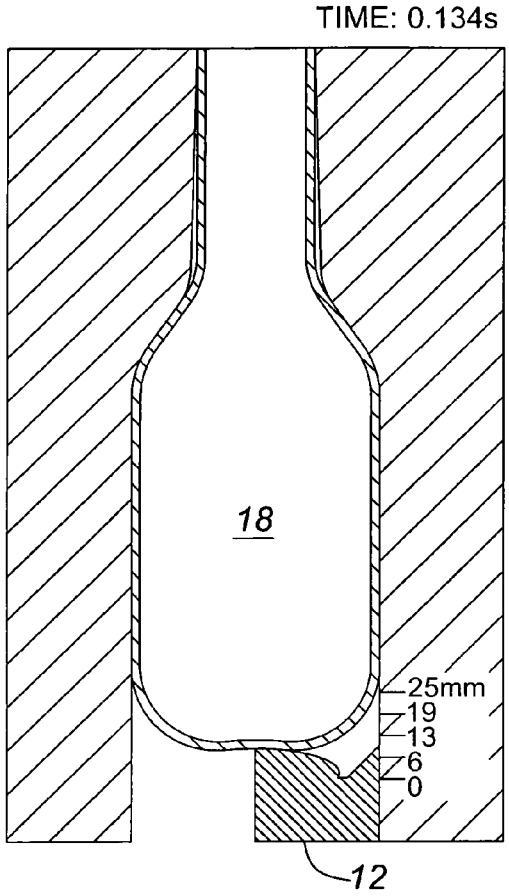
Figure 6D:
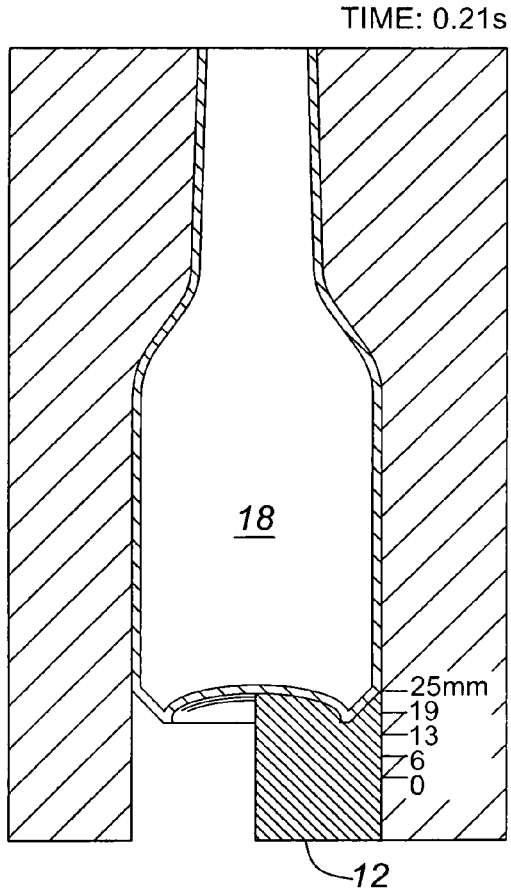

The ram serves two essential functions in the forming of the aluminum bottle. It limits the axial tensile strains and forms the shape of the bottom of the container. Initially the ram-driven punch 12 is held in close proximity to, or just touching, the bottom of the preform 18 (FIG. 6A). This serves to minimize the axial stretching of the preform side wall that would otherwise occur as a result of internal pressurization. Thus, as the internal pressure is increased, the side wall of the preform will expand to contact the inside of the die without significant lengthening. In these procedures, at some point in time the bottom of the preform will become nearly hemispherical in shape, with the radius of the hemisphere approximately equal to that of the die cavity (FIG. 6B). It is at or just before this point in time that the ram must be actuated to drive the punch 12 upwards (FIG. 6C). The profile of the nose of the ram (i.e. the punch surface contour) defines completely the profile of the bottom of the container. As the internal fluid pressure completes the molding of the preform against the die cavity wall (compare the bottle shoulder and neck in FIGS. 6B, 6C and 6D), the motion of the ram, combined with the internal pressure, forces the bottom of the preform into the contours of the punch surface in a manner that produces the desired contour (FIG. 6D) without excessive tensile strains that could, conceivably, lead to failure. The upward motion of the ram applies compressive forces to the hemispherical region of the preform, reduces general strain caused by the pressurizing operation, and assists in feeding material radially outwards to fill the contours of the punch nose.

If the ram motion is applied too early, relative to the rate of internal pressurization, the preform is likely to buckle and fold due to the compressive axial forces. If applied too late, the material will undergo excessive strain in the axial direction causing it to fail. Thus, coordination of the rate of internal pressurization and motion of the ram and punch nose is required for a successful forming operation. The necessary timing is best accomplished by finite element analysis (FEA) of the process. FIG. 3 is based on results of FEA.

PRF procedures have been thus far described, and exemplified in FIG. 3, as if no positive (i.e., superatmospheric) fluid pressure were applied to the outside of the preform within the die cavity. In such a case, the external pressure on the preform in the cavity would be substantially ambient atmospheric pressure. As the preform expands, air in the cavity would be driven out (by the progressive diminution of volume between the outside of the preform and the die wall) through a suitable exhaust opening or passage provided for that purpose and communicating between the die cavity and the exterior of the die.

Stated with specific reference to aluminum containers, by way of illustration, it has been shown by FEA that in the absence of any applied positive external pressure, once the preform starts to deform (flow) plastically, the strain rate in the preform becomes very high and is essentially uncontrollable, owing to the low or zero work hardening rate of aluminum alloys at the process temperature (e.g. about 300° C.) of the pressure-ram-forming operation.

That is to say, at such temperatures the work hardening rate of aluminum alloys is essentially zero and ductility (i.e., forming limit) decreases with increasing strain rate. Thus, the ability to make the desired final shaped container product is lessened as the strain rate of the forming operation increases and the ductility of aluminum decreases.

In accordance with a further feature of PRF procedures, positive fluid pressure is applied to the outside of the preform in the die cavity, simultaneously with the application of positive fluid pressure to the inside of the preform. These external and internal positive fluid pressures are respectively provided by two independently controlled pressure systems. The external positive fluid pressure can be conveniently supplied by connecting an independently controllable source of positive fluid pressure to the aforementioned exhaust opening or passage, so as to maintain a positive pressure in the volume between the die and the expanding preform.

Figure 7:
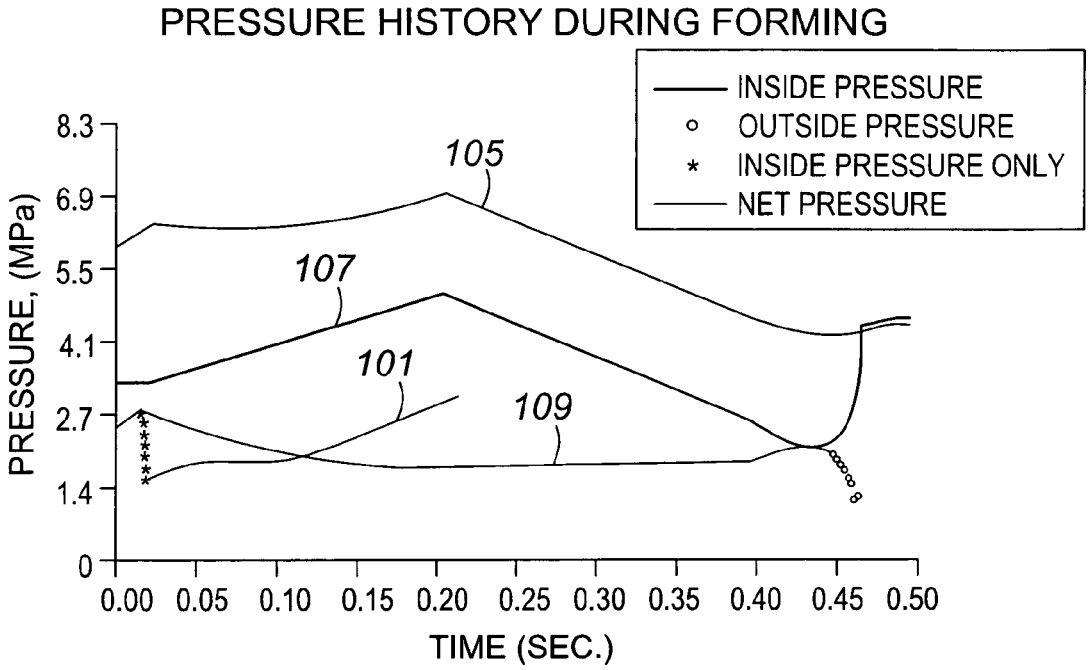
FIG. 7 is a graph of pressure variation over time (using arbitrary time units) illustrating the feature of simultaneously applying independently controllable internal and external positive fluid pressures to the preform in the die cavity and comparing therewith internal pressure variation (as in FIG. 3) in the absence of external positive pressure.
Figure 8:
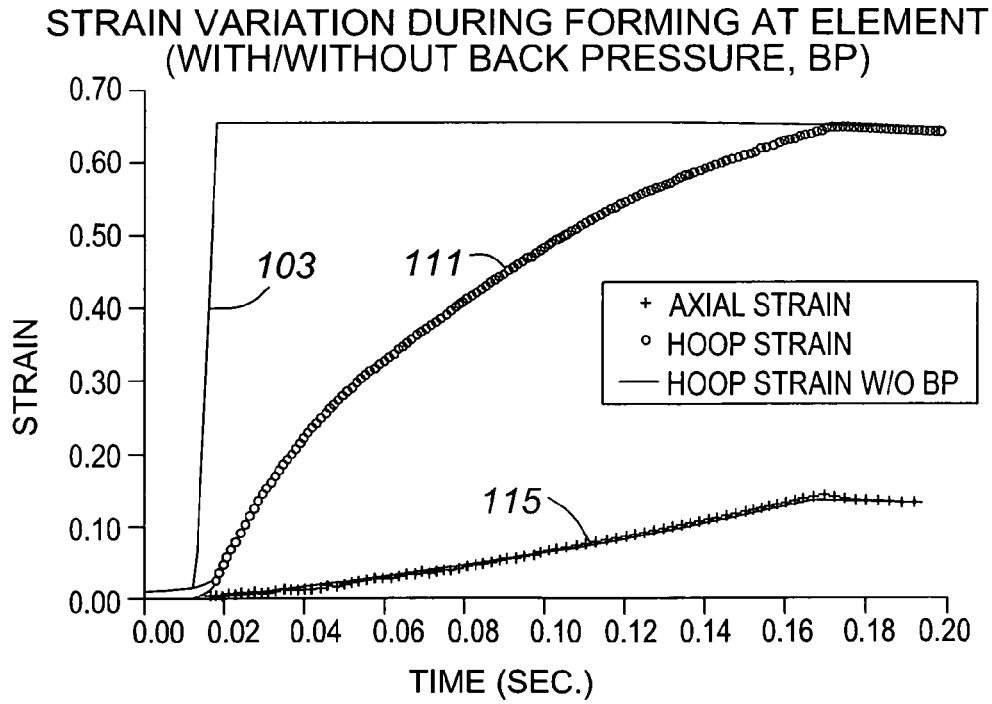
FIG. 8 is a graph of strain variation over time, derived from finite element analysis, showing strain for one particular position (element) under the two different pressure conditions compared in FIG. 7.

FIGS. 7 and 8 compare the pressure vs. time and strain vs. time histories for pressure-ram-forming a container with and without positive external pressure control (the term "strain" herein refers to elongation per unit length produced in a body by an outside force). Line 101 of FIG. 7 corresponds to the line designated "Pressure" in FIG. 3, for the case where there is no external positive fluid pressure acting on the preform; line 103 of FIG. 8 represents the resulting strain for one particular position (element) as determined by FEA. Clearly the strain is almost instantaneous in this case, implying very high strain rates and very short times to expand the preform into contact with the die wall. In contrast, lines 105, 107 and 109 of FIG. 7 respectively represent internal positive fluid pressure, external positive fluid pressure, and the differential between the two, when both internal and external pressures are controlled, i.e., when external and internal positive fluid pressures, independently controlled, are simultaneously applied to the preform in the die cavity; the internal pressure is higher than the external pressure so that there is a net positive internal-external pressure differential as needed to effect expansion of the preform. Line 111 in FIG. 8 represents the hoop strain (strain produced in the horizontal plane around the circumference of the preform as it is expanding) for the independently controlled internal-external pressure condition represented by lines 105, 107 and 109; it will be seen that the hoop strain shown by line 111 reaches the same final value as that of line 103 but over a much longer time and thus at a much lower strain rate. Line 115 in FIG. 8 represents axial strain (strain produced in the vertical direction as the preform lengthens).

By simultaneously providing independently controllable internal and external positive fluid pressures acting on the preform in the die cavity, and varying the difference between these internal and external pressures, the forming operation remains completely in control, avoiding very high and uncontrollable strain rates. The ductility of the preform, and thus the forming limit of the operation, is increased for two reasons. First, decreasing the strain rate of the forming operation increases the inherent ductility of the aluminum alloy. Second, the addition of external positive pressure decreases (and potentially could make negative) the hydrostatic stress in the wall of the expanding preform. This could reduce the detrimental effect of damage associated with microvoids and intermetallic particles in the metal. The term "hydrostatic stress" herein refers to the arithmetic average of three normal stresses in the x, y and z directions.

The feature thus described enhances the ability of the pressure-ram-forming operation to successfully make aluminum containers in bottle shapes and the like, by enabling control of the strain rate of the forming operation and by decreasing the hydrostatic stress in the metal during forming.

The selection of pressure differential is based on the material properties of the metal from which the preform is made. Specifically, the yield stress and the work-hardening rate of the metal must be considered. In order for the preform to flow plastically (i.e., inelastically), the pressure differential must be such that the effective (Mises) stress in the preform exceeds the yield stress. If there is a positive work-hardening rate, a fixed applied effective stress (from the pressure) in excess of the yield stress would cause the metal to deform to a stress level equal to that applied effective stress. At that point the deformation rate would approach zero. In the case of a very low or zero work-hardening rate, the metal would deform at a high strain rate until it either came into contact with the wall of the mold (die) or fracture occurred. At the elevated temperatures anticipated for the PRF process, the work-hardening rate of aluminum alloys is low to zero.

Examples of gases suitable for use to supply both the internal and external pressures include, without limitation, nitrogen, air and argon, and any combinations of these gases.

The plastic strain rate at any point in the wall of the preform, at any point in time, depends only on the instantaneous effective stress, which in turn depends only on the pressure differential. The choice of external pressure is dependent on the internal pressure, with the overall principle to achieve and control the effective stress, and thus the strain rate, in the wall of the preform.

Figure 9:
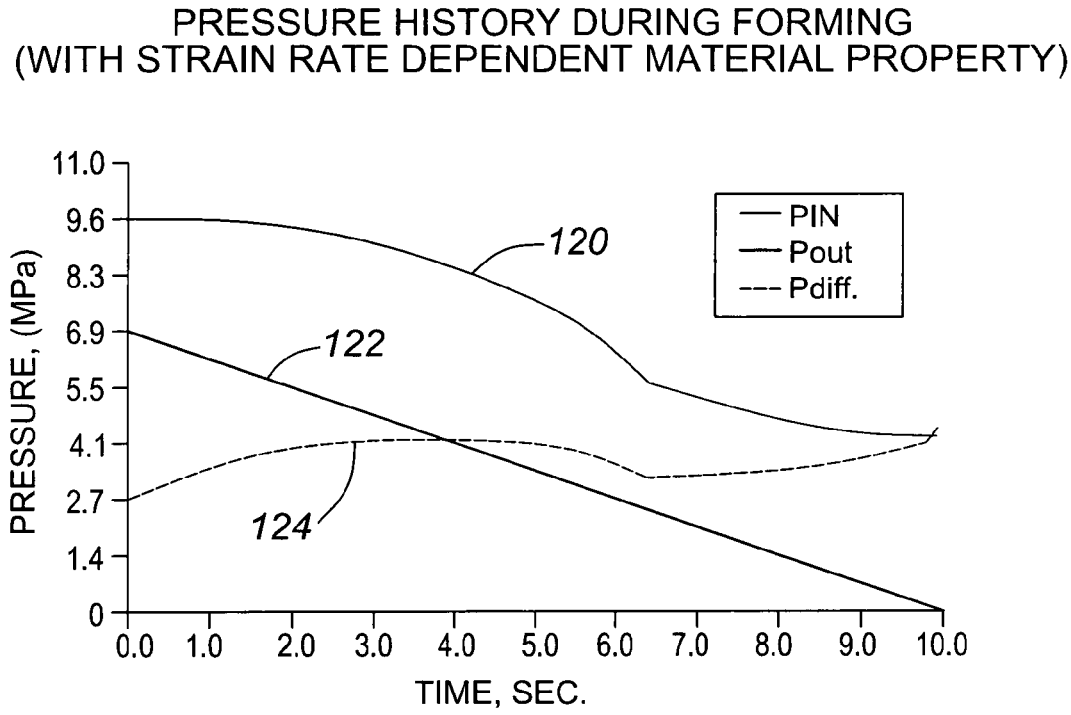
FIG. 9 is a graph similar to FIG. 7 illustrating a particular control mechanism that can be used in the forming process when internal and external positive fluid pressures are simultaneously applied to the preform in the die cavity.

FIG. 9 shows a different control mechanism that can be used in the forming process. Finite element simulations have been used to optimize the process. In FIG. 9, line 120 represents internal pressure (Pin) acting on the preform, line 122 represents external pressure (Pout) acting on the preform, and line 124 represents the pressure differential (Pdiff=Pin−Pout) . This figure shows the pressure history from one control method. In this case, the fluid mass in the internal cavity is kept constant and the pressure in the external cavity (outside the preform) is decreasing linearly. Strain rate-dependent material properties are also included in the simulation. This latter control mechanism is currently preferred because it results in a simpler process.

Figure 10:
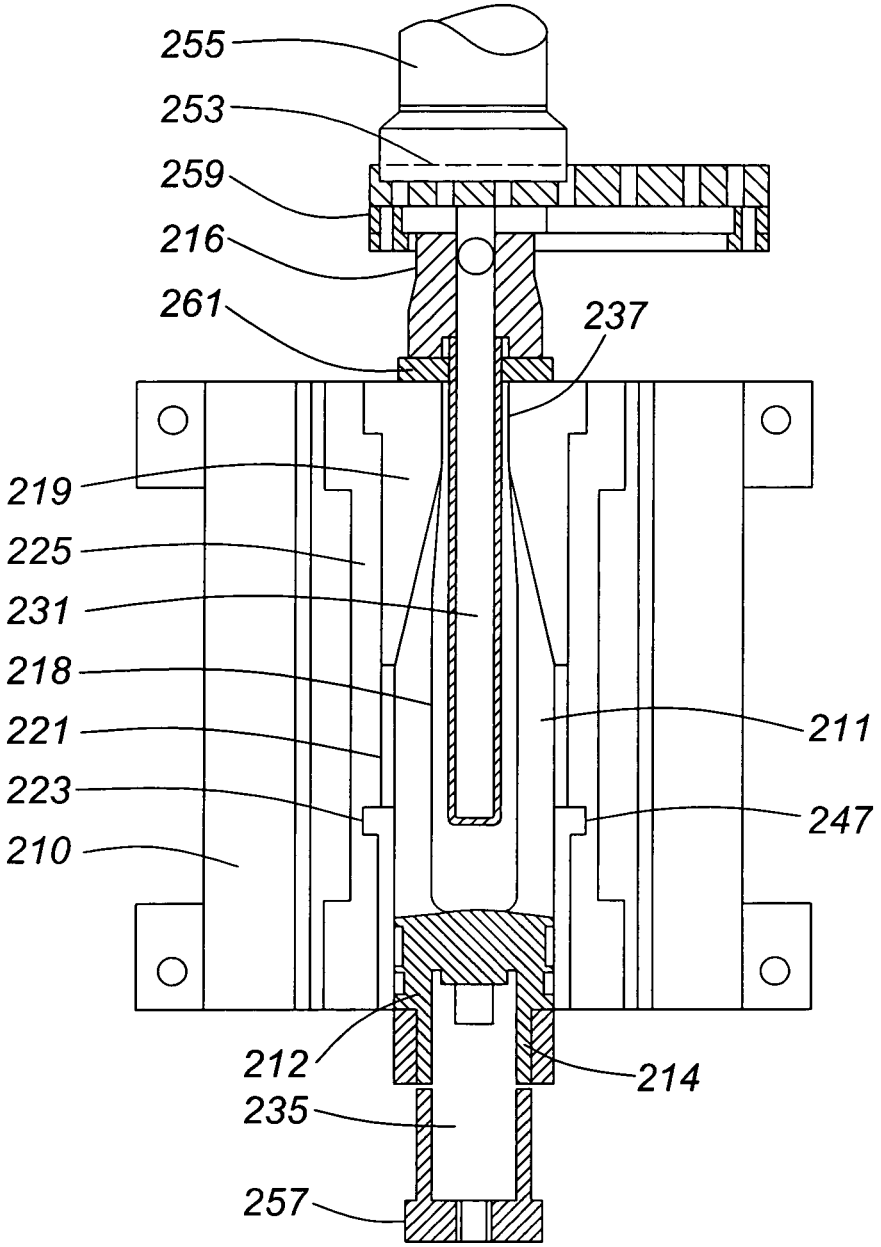
FIG. 10 is an elevational sectional view of an illustrative embodiment of apparatus for use in performing a PRF method.

An example of apparatus for performing certain PRF procedures to form a metal container is illustrated in FIGS. 10-13. This apparatus includes a split die 210 with a profiled cavity 211 defining an axially vertical bottle shape, a punch 212 contoured to impart a desired container bottom configuration (which may be asymmetric), a backing ram 214 for moving the punch, and a sealing ram 216 for sealing the open upper end of the die cavity and of a metal (e.g. aluminum) container preform 218 when the preform is inserted within the cavity as shown in FIG. 10, as well as additional components and instrumentalities described below.

In the split die of the apparatus of FIGS. 10-13, interchangeable primary inserts 219 and secondary profile sections or inserts 221 and 223 fit onto the inner surface of a split insert holder 225 received in the split main die member 210.

These sections can serve as stencils, having inner surfaces formed with relief patterns (the term "relief" being used herein to refer to both positive and negative relief) for applying decoration or embossing to the metal container as it is being formed. Each insert 219, 221 and 223 is itself a split insert, formed in two separate pieces (219*a*, 219*b*; 221*a*, 221*b*; 223*a*, 223*b*) that are respectively fitted in the two separate split insert holder halves 225*a*, 225*b*, which are in turn respectively received in axially vertical facing semicylindrical channels of the two split main die member halves 210*a*, 210*b*.

Gas is fed to the die through two separate channels for both internal and external pressurization of the preform. The supply of gas to the interior of the die cavity externally of the preform may be effected through mating ports in the die structure 210 and insert holder 225, from which there is an opening or channel to the cavity interior (for example) through an insert 219, 221 or 223; such an opening or channel will produce a surface feature on the formed container, and accordingly is positioned and configured to be unobtrusive, e.g. to constitute a part of the container surface design. Heating elements may be incorporated in the die. A heating element 231 is mounted inside the preform, coaxially therewith; this heating element can eliminate any need to preheat the gas that, as in other embodiments of the present method (described above), is supplied to the interior of the preform to expand the preform.

The foregoing features of the apparatus of FIGS. 10-13 enable enhanced rapidity of die changes, reduced energy costs and increased production rates.

As is additionally illustrated in the apparatus of FIGS. 10-13, screw threads or lugs (to enable attachment of a screw closure cap) and/or a neck ring can be formed in a neck portion of the container during and as a part of the PRF procedure itself, rather than by a separate necking step, again for the sake of increasing production rates. This is accomplished by creating a negative thread or lug pattern in the inner surface portion of the split die corresponding to the neck of the formed container, so that as the preform expands (in the neck region of the die cavity) the thread or lug relief pattern is imparted thereto. For such thread-forming operation, at least the neck portion of the preform is made smaller in diameter than the neck of the final formed container.

Figure 11:
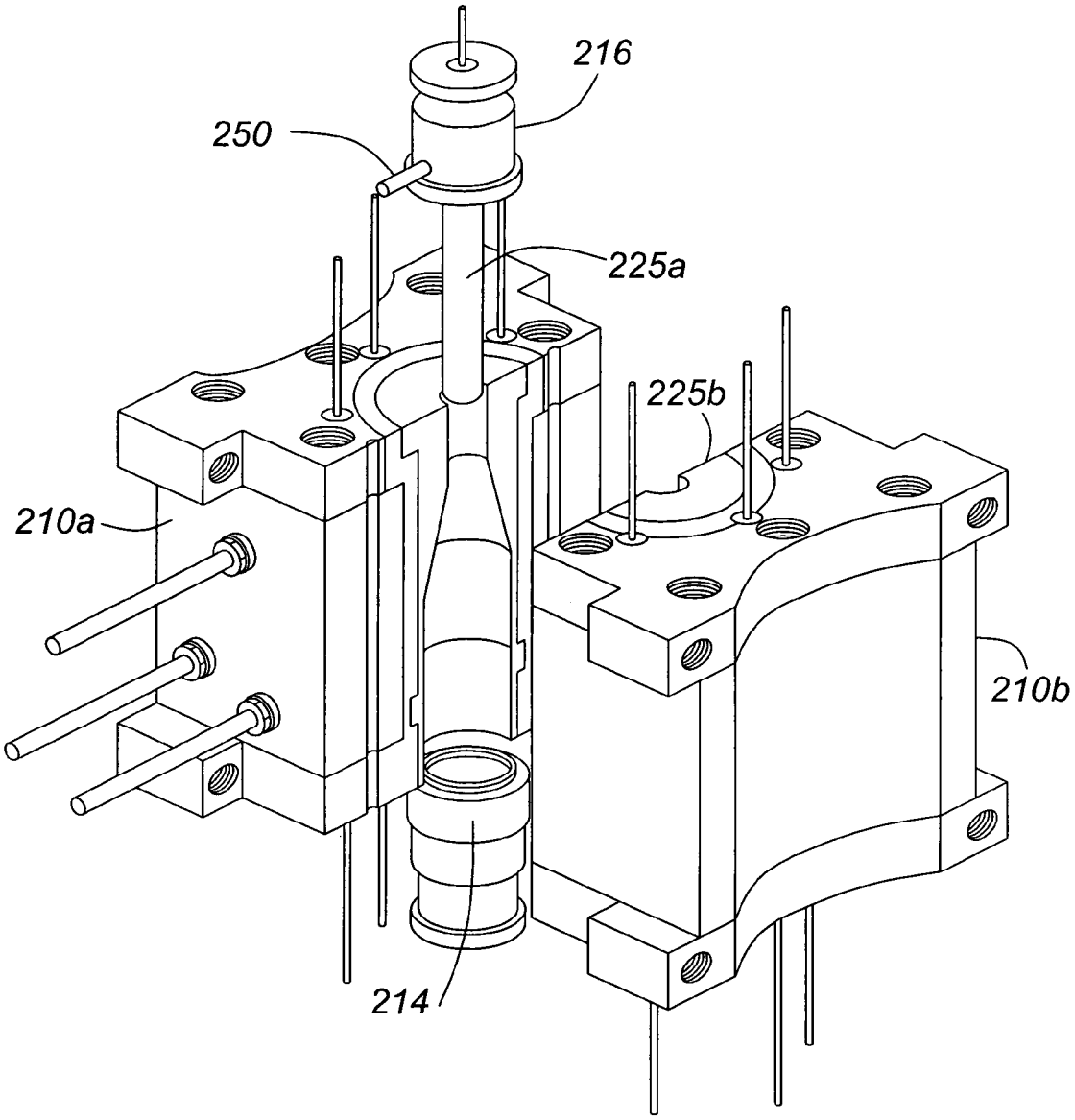
FIG. 11 is a perspective view, partly exploded, of the apparatus of FIG. 10.
Figure 12A:
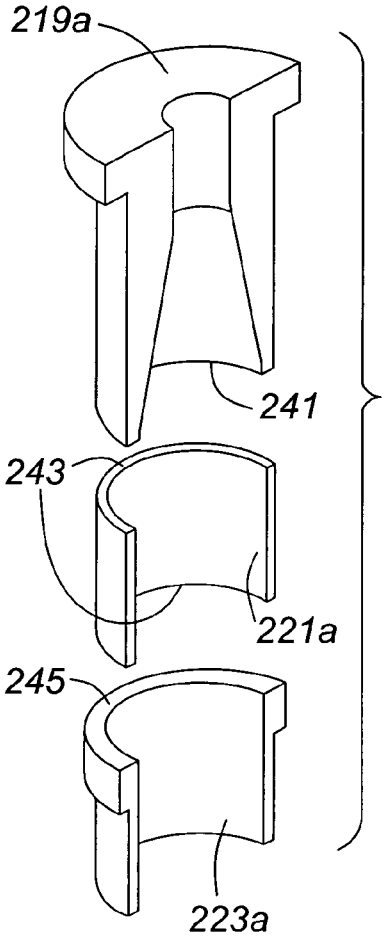
FIGS. 12A, 12B and 12C are perspective views of one half of the split die of the apparatus of FIGS. 10 and 11 respectively illustrating the split inserts of the split die half in exploded view, the split insert holder, and the inserts and holder in assembled relation.
Figure 12B:
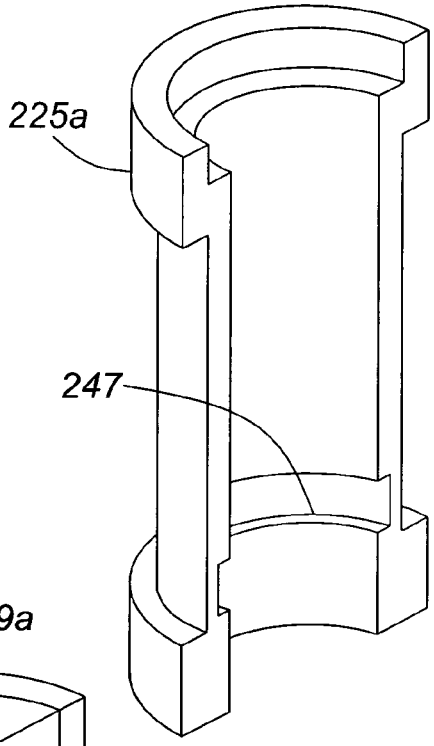
Figure 12C:
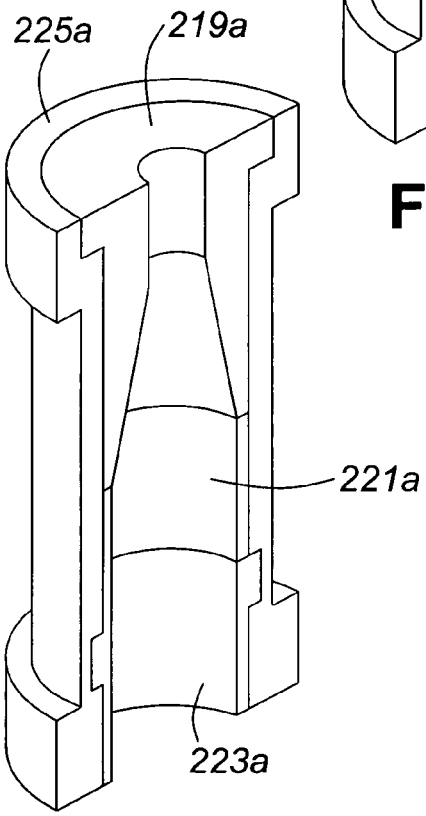
Figure 13:
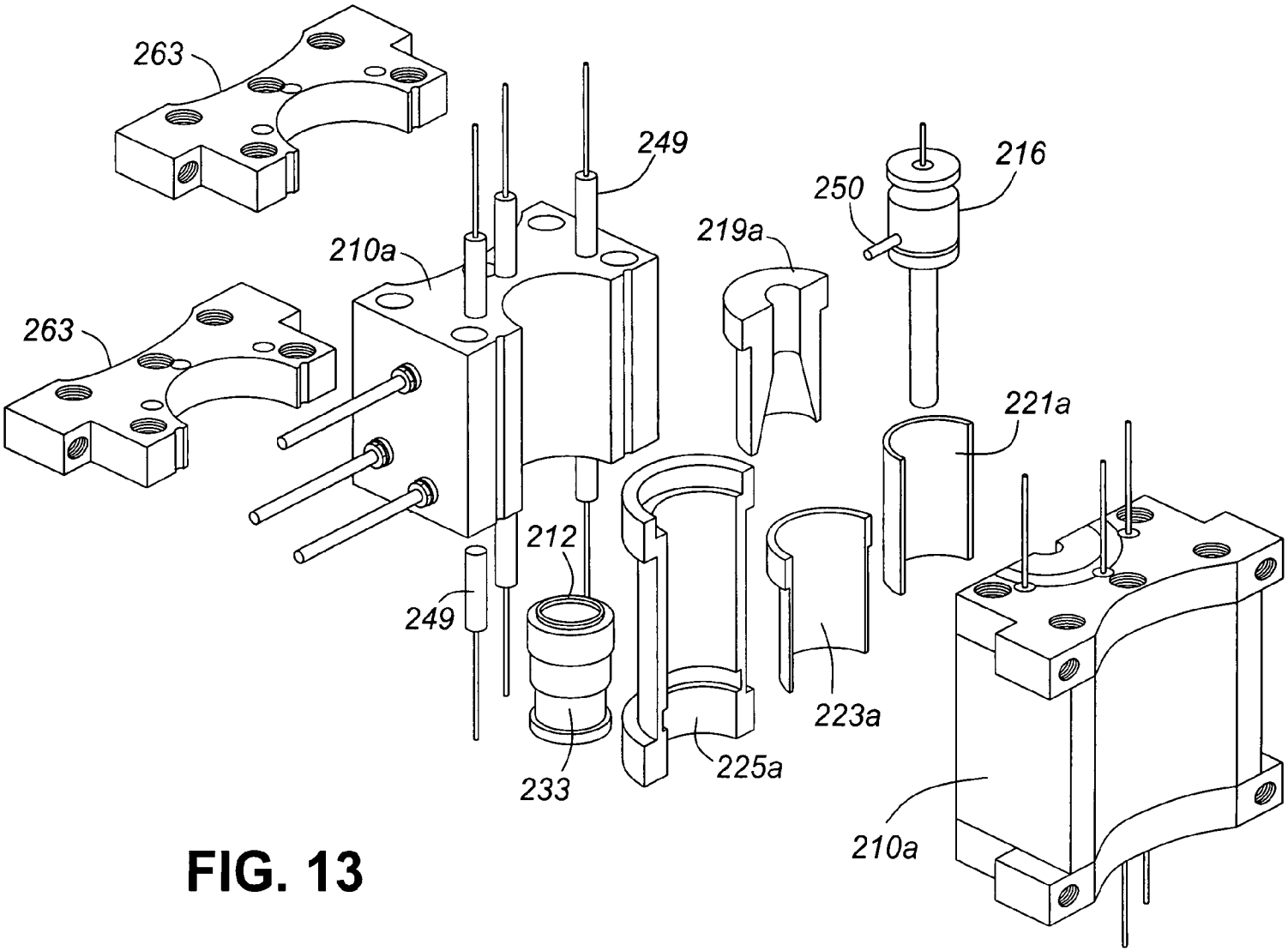
FIG. 13 is a fully exploded perspective view of the apparatus of FIGS. 10 and 11.

Stated with particular reference to FIGS. 11-13, the insert holder is constituted of two mirror-image halves 225*a*, 225*b* each having an axially vertical and generally semi-cylindrical inner surface. The primary insert 219 and the two secondary split inserts 221 and 223 are disposed in contiguous, tandem succession along the axis of the die cavity, each half of each secondary insert being fitted into one half of the split insert holder so that, when the two halves of the insert holder are brought together in facing relation, the two halves of each split insert are in facing register with each other. The primary and secondary inserts mate with each other at their horizontal edges 241, 243, 245 and have outer surfaces that interfit with features such as ledges 247 formed in the inner surfaces of the halves of the split insert holder. Together, the inserts constitute the entire die wall defining the shape of the container to be formed.

Each of the primary profile insert halves 219*a* and 219*b* has an inner surface defining half of the upper portion, including the neck, of the desired container shape, such as a bottle shape. As indicated at 237 in FIG. 10, the neck-forming surface of each half of this primary split insert may be contoured as a screw thread for imparting a cap-engaging screw thread to the neck of the formed container. The remainder of the inner surface of the primary split insert may be smooth, to produce a smooth-surfaced container, or textured to produce a container with a desired surface roughness or repeat pattern.

One or both halves of either or both of the two (upper and lower) secondary profile inserts 221 and 223 may have an inner surface configured to provide positive and/or negative relief patterns, designs, symbols and/or lettering on the surface of the formed container. Advantageously, multiple sets of interchangeable inserts are provided, e.g. with surface features differing from each other, for use in producing formed metal containers with correspondingly different designs or surfaces. Tooling changes can then be effected very rapidly and simply by slipping one set of inserts out of the insert holders and substituting another set of inserts that is interchangeable therewith. Sealing between opposite components of the split die is accomplished by precision machining that eliminates the need for gaskets and rings.

In the apparatus shown, the split die member 210 is heated by twelve rod heaters 249, each half the vertical height of the die set, inserted vertically in the die assembly from the top and bottom, respectively. The gas for internal and external pressurization of the preform within the die cavity can be preheated by passing through two separate channels in the two component pressure containment blocks (split die member 210). The channel for external pressurization vents into the die cavity, while the channel for internal pressurization vents to the interior of the preform via the sealing ram 216, to which gas is delivered through sealing ram gas port 250.

The heating element 231 is a heater rod attached to the sealing ram and located coaxially with the preform, extending downwardly into the preform, near to the bottom thereof, through the open upper end of the preform, when the sealing ram is in its fully lowered position for performance of a PRF procedure. Element 231 has its own separate temperature control system (not shown). With this arrangement, preheating of the gas may be avoided, enabling elimination of gas preheating equipment and also at least largely avoiding the need to preheat the die components, since only the preform itself needs to be at an elevated temperature. The sealing ram is provided with a ceramic temperature isolation ring 253 to prevent overheating of adjacent hydraulics and load cells.

As further shown in FIGS. 10 and 13, the apparatus is also provided with a hydraulic sealing ram adapter 255 and a hydraulic backing ram adapter 257; an isolation ring-sealing ram adapter 259; sealing ram ring 261; and upper and lower pressure containment end caps 263 for each half of the split main die member 210. A cam system could be used as an alternative to hydraulics for moving the rams.

The Present Invention

Figure 14A:
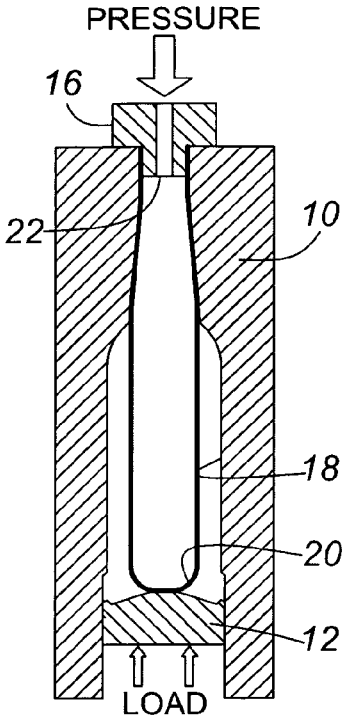
FIGS. 14A, 14B and 14C are schematic sectional elevational views showing successive stages in the performance of a PRF method in which the preform undergoes progressive expansion from open end to closed end, as in embodiments of the present invention.
Figure 14B:
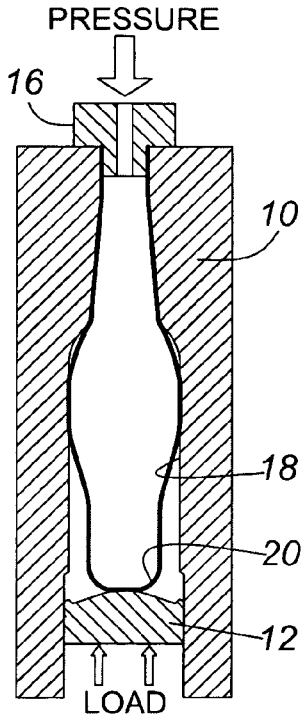
Figure 14C:
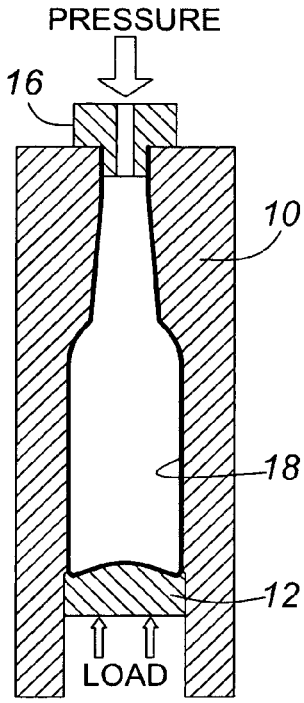

As embodied in PRF procedures of the types described above, the method of the present invention affords a new and improved way to effect progressive outward expansion of the preform from its open end to its closed end, i.e., in the convention of orientation herein illustrated, from the top to the bottom of the die, during the step of subjecting the preform (disposed in the die cavity) to internal fluid pressure. Such progressive outward expansion is illustrated in FIGS. 14A, 14B and 14C, for the case of a preform 18 undergoing pressure-ram-forming in a die 10 as in FIG. 1. Initially, the elongated, generally cylindrical preform, with its closed lower end 20 and upper open end 22, is disposed within the profiled die cavity 11 (FIG. 14A). At this time, the punch 12 at the bottom of the die cavity may be positioned to engage the preform lower end 20. As the preform is subjected to internal pressure of fluid introduced through pressure fitting 16, with the punch shown (in this instance) as remaining stationary, the preform side wall begins to bulge outwardly. Desirably, this outward bulging begins in the upper part of the preform (FIG.

14B) and proceeds downwardly to the lower part of the preform until the entire preform side wall engages the die cavity wall (FIG. 14C), while the punch moves upwardly to shape the lower end of the preform.

Heretofore, in PRF operations, such progressive expansion has been achieved by establishing a temperature gradient along the length of the preform from top to bottom, with the upper portion of the preform (near its open end) heated to the highest temperature, and a progressive decrease in temperature to the lower (closed) end of the preform. As the upper portion of the preform, being at the highest temperature, bulges out first until it comes into contact with the die cavity, it locks the preform in the die while the punch pushes up against the base (closed end) of the preform to form the base profile.

In accordance with the present invention, instead of employing a temperature gradient along the preform length to cause progressive expansion, a preform is provided having a thickness gradient along the preform side wall, with the thickest part of the side wall being at the base (closed end) of the preform and with a progressive decrease of wall thickness in an upward direction (toward the open top end of the preform). Owing to this wall thickness gradient, the thinnest (upper) part of the preform side wall bulges outwardly first when internal pressure is applied, and as the pressure increases during forming, the outward expansion of the preform progresses downwardly to the closed end, in the manner shown in FIGS. 14A, 14B and 14C.

Figure 15:
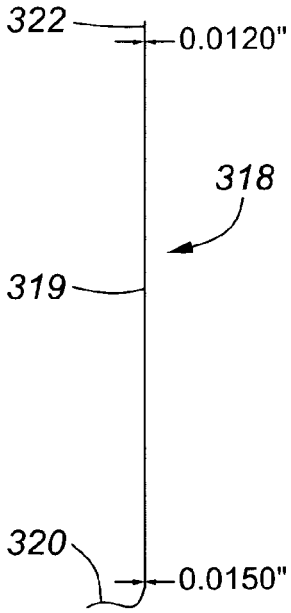
FIG. 15 is a fragmentary sectional elevational view of an example of a preform for use in the method of the invention.

A preform 318 having a wall thickness gradient producing progressive expansion is shown in FIG. 15, which represents a longitudinal section through the preform side wall 319 and an adjacent portion of the closed end 320. As there indicated, the preform side wall has a maximum thickness of 0.0150 inch adjacent the closed end 320 and decreases progressively to a minimum thickness of 0.0120 inch adjacent the open end 322.

Such a preform can be readily produced by a drawing and ironing procedure as exemplified in FIGS. 16-24. Referring first to FIGS. 17A and 17B, a flat, circular aluminum sheet blank 324, suitably lubricated, is subjected to a cupping operation on a first machine where a tool pack forms the blank into a cup 326 using standard draw methods. The cup is then transferred to a redraw tool pack and undergoes a first redraw to produce a lengthened workpiece 328 with reduced diameter; in the same manner, a second redraw is performed, to effect further lengthening and reduction of workpiece diameter as indicated at 330. At this stage, the redrawn cups are trimmed to remove non-uniform tops and to size the preform height. The cups are transferred again to a body maker for a third redrawing (with yet further lengthening and reduction in diameter, indicated at 332) and an ironing step with a tapered punch 334 (FIG. 16) to reduce the side wall thickness of the preform to a predetermined thickness with a thickness gradient along the side wall. After exiting the body maker, the preforms are trimmed to remove any nonuniformity at the open end and to size the preform height. The trimmed preform 318 is cleaned and necked to reduce the diameter of the top opening, after which a desired closure finish is formed.

Figure 16:
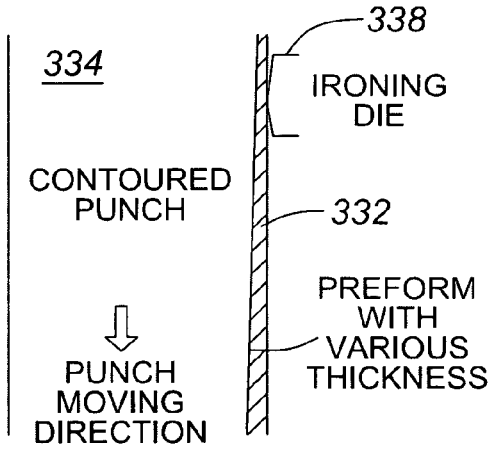
FIG. 16 is a schematic view illustrating an ironing step for producing a preform of the type shown in FIG. 15.
Figure 17A:
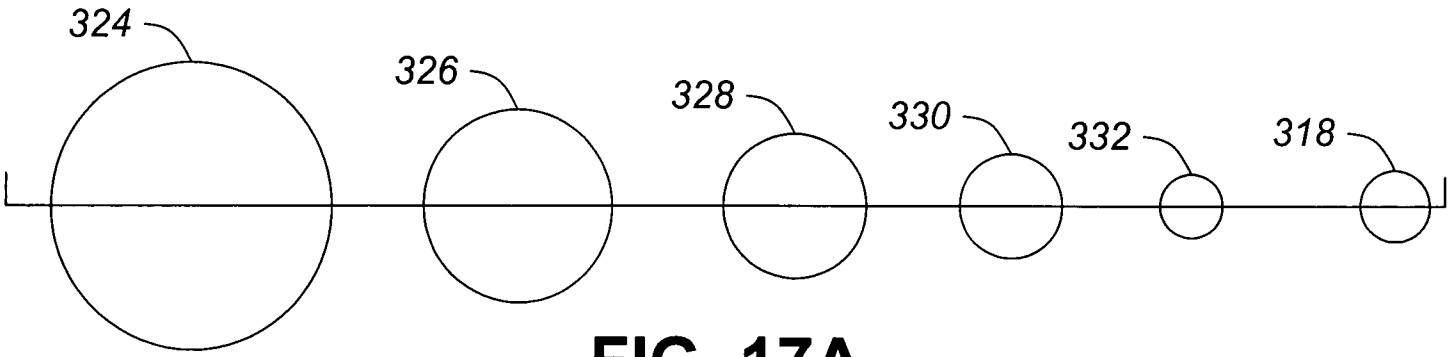
FIGS. 17A and B are, respectively, simplified schematic plan and elevational sectional views of successive stages in the production of a preform of the type shown in FIG. 15, FIG. 17B being taken as along line B-B of FIG. 17A.
Figure 17B:
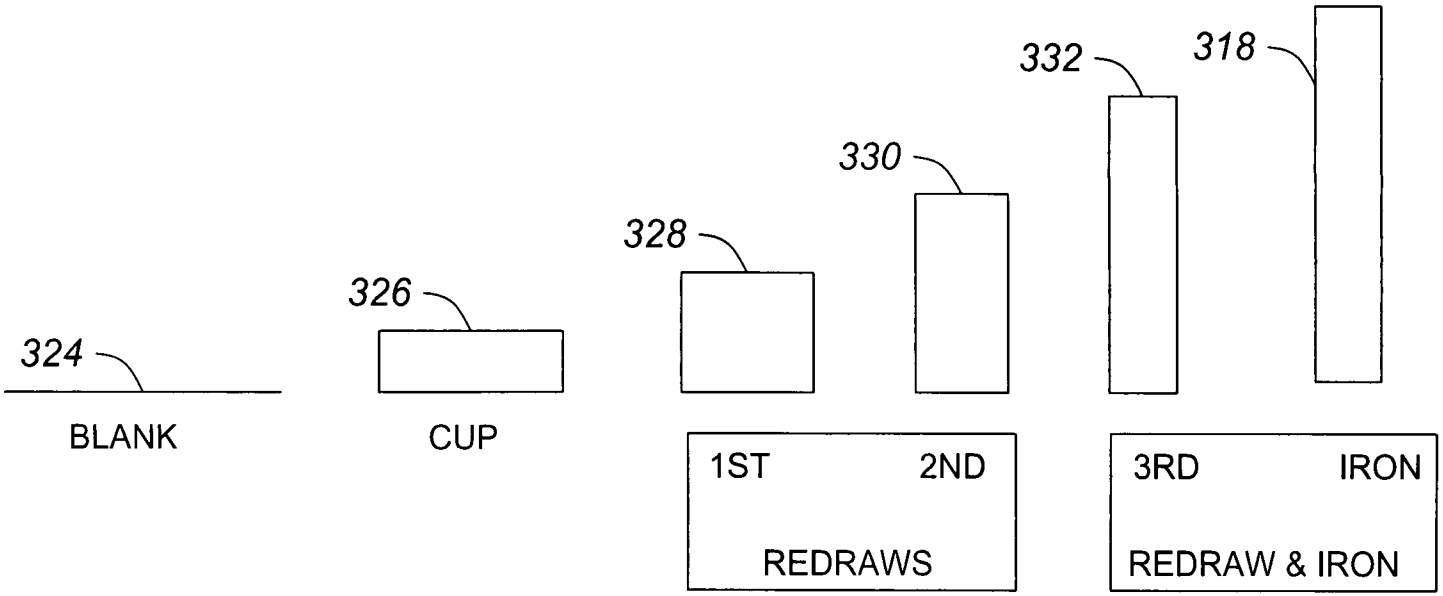

With further reference to FIG. 16, in the ironing step the workpiece 332 is placed within an ironing die 338, and the contoured (tapered) punch 334, having its smallest diameter at its extremity adjacent to the closed end of the workpiece, is introduced into the workpiece through the open end thereof. The profile of the tapered punch defines the side wall thickness gradient of the produced preform since the diameter of the ironing die is fixed. As the punch moves within the die, along the common axis of punch and die, the region of largest punch diameter (smallest gap between punch and ironing die) results in the thinnest portion of the preform wall, while the region of smallest punch diameter (largest gap between punch and die) results in the thickest portion of the preform wall. Stated generally, pertinent parameters may be in the ranges set forth in TABLE 1.

TABLE 1

| Parameter | Working Range | Preferred Range |
|---|---|---|
| Sheet starting gauge | | |
| inch | 0.005-0.100 | 0.010-0.030 |
| mm | 0.13-2.5 | 0.25-0.76 |
| Punch taper, degrees | 0.0001-1.0 | 0.01-0.10 |
| Wall thickness variation | 1-50% | 20-40% |

The wall thickness variation is the difference between the greatest (T1) and least (T2) wall thickness, expressed as $[(T1-T2)/T2]\times 100\%$.

In further illustration of the invention, reference may be made to the following specific Example.

Example

Figure 18A:
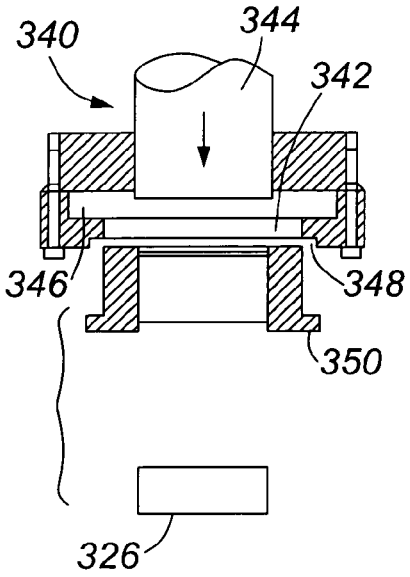
FIGS. 18A, 18B, 18C and 18D are simplified schematic elevational sectional views in illustration of successive cupping, redrawing and ironing operations in the production of a preform with a wall thickness gradient for use in particular embodiments of the method of the invention.
Figure 18B:
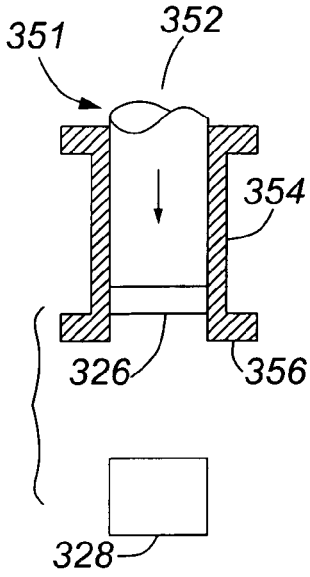
Figure 18C:
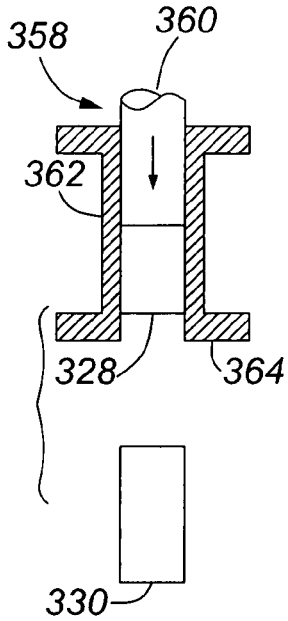
Figure 18D:
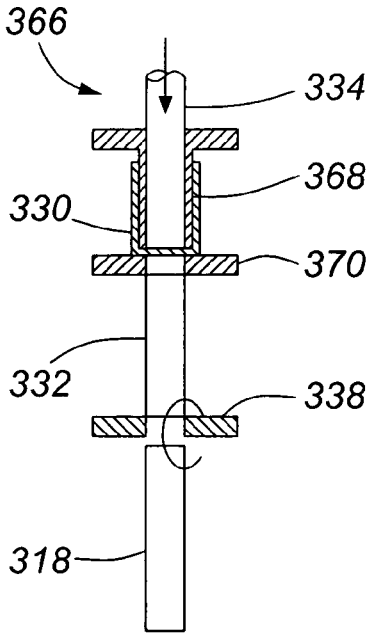

An aluminum tapered wall preform for use in practicing the method of the invention was formed in five discrete stages, which are shown schematically in FIGS. 18A, B, C and D. These five stages, discussed above with reference to FIGS. 17A and B, were cupping, first redraw, second redraw, body making (i.e. third redraw and wall ironing), and trimming.

Table 2 lists blank size, redraw diameter, and percentage of reduction used to produce the taper wall preforms. The forming of work example preforms used standard blank and draw, redraw and draw and iron processes.

TABLE 2

| | Diameter (in.) | Reduction (%) |
|---|---|---|
| Blank 324 | 6.217 | — |
| Draw (cup) 326 | 4.165 | 33.01 |
| 1st Redraw 328 | 3.000 | 27.97 |
| 2nd Redraw 330 | 2.050 | 31.67 |
| 3rd Redraw 332 | 1.468 | 28.39 |

The blank and draw operation was performed using a generic blank and draw tool pack in a commercial cupper press 340. A coil of AA3104 aluminum alloy, H19 temper, 0.0199 inch gauge can body stock 342 was fed into the cupper press and pre-lubricated with DTI C1 cupper lubricant. In this press, which included a punch 344, draw pad 346, cutting edge 348 and draw die 350, the sheet was blanked (cut into blanks 324, see FIGS. 17A and B) and drawn into cups 326.

Cups from the blank and draw operation were transferred to a redraw press wherein the first redraw operation was performed using a generic redraw tool pack 351 (FIG. 18B) including a punch 352, first redraw sleeve 354 and first redraw die 356, to produce first-redrawn cups 328.

The first-redrawn cups were pre-lubricated by dipping in a 7:1 emulsion of warm water and DTI C1 cupper lubricant and the second redraw operation was performed in a servo hydraulic dual axis press using a generic laboratory redraw tool pack 358 (FIG. 18C) including a punch 360, second redraw sleeve 362 and second redraw die 364, to produce second-redrawn cups 330.

At this stage the second-redrawn cups were trimmed to remove non-uniform tops and washed to remove trimming debris. The modified second-redrawn cups were pre-lubricated by dipping in a 7:1 emulsion of warm water and DTI C1 cupper lubricant, and transferred to a generic laboratory vertical body maker tool pack 366 (FIG. 18D) including a tapered punch 334 as described above and, in succession, a third redraw sleeve 368, a third redraw die 370, and an ironing ring or ironing die 338. In the body maker, the cups underwent a standard draw and iron process, first passing through the third redraw die 370 to produce the third-redrawn cups 332, and then passing through the ironing ring 338 to produce the tapered-wall preforms 318, using the tapered punch 334 for both operations. Ironing ring lubrication (a 10:1 emulsion of water and DTI C1 lubricant) was supplied by a closed loop lubrication system (not shown) including a coolant/lubrication ring.

Figure 19:
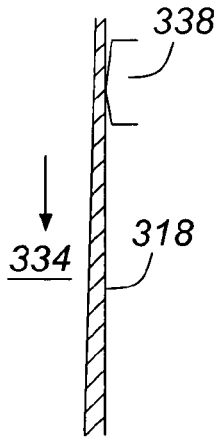
FIG. 19 is an enlarged fragmentary view of a portion of FIG. 18D.

The third redraw die 370 was dimensioned to receive the widest part of the ironing punch 334 and the thickness of the sidewall of the second-redrawn cups 330; hence no thinning of the cup sidewalls occurred during the third redraw stage. The diameter of the ironing ring 338, however, was smaller, being so selected that the tapered punch in combination therewith reduced the sidewall thickness of the preforms to a predetermined thickness with a gradient along the sidewall (FIG. 19). The ironing reduction relative to the original sheet gauge in this working example was 14.57% adjacent the closed end, tapering to 29.6% at the open end.

Figure 20:
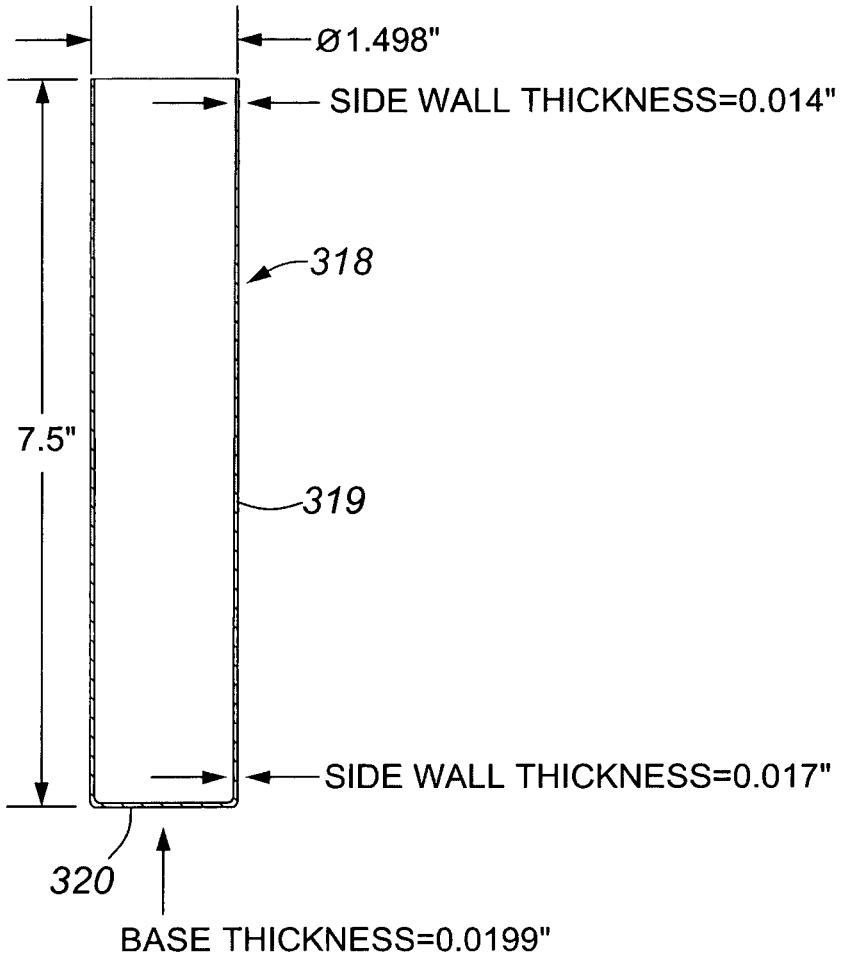
FIG. 20 is a sectional elevational view of a tapered wall preform as produced by the operations illustrated in FIGS. 18A-18D.

After exiting the vertical body maker, the preforms 318 were trimmed to remove any non-uniformity at the top and to impart to them a height of 7.5 inches. A cross sectional view showing the thickness gradient and preform dimensions is shown in (FIG. 20).

The trimmed preforms were cleaned in an emulsion of warm water and soap, and were flanged (FIGS. 21A and 21B) at the open end to permit sealing in the forming molds, using a flanging tool 372 placed into the open end of the preform and manually struck with a dead blow hammer to produce a quarter inch sealing flange 374. Next, the flanged preforms were transferred to an oven, wherein they were fully annealed at 450° C. for a time of five minutes. After achieving a full anneal, they were permitted to air cool for one half hour.

The preforms thus produced in this working example were subjected to a Pressure Ram Forming process in a laboratory multi axis servo hydraulic machine 375 (FIG. 22) including a die or mold cavity 411, punch 412 with backing ram 414, and seal ram 416. A tapered wall perform 318 with a thickness gradient in the side wall as described above was first placed into the machine and the mold cavity was fully closed. The preform was given a 90 second preheat period within the cavity to insure even heat distribution along the preform. The mold cavity temperature was set with no gradients to a temperature of 250° C. After the preheat period the Pressure Ram Forming program was executed. During this forming cycle the preform was subjected to a flange sealing load of 1500 lbs and an internal pressure of 400 psi at a rate of 300 psi/second. At the same time the backing ram began to travel a distance of 0.4 inch at a rate of 0.133 inch/second. During this process the preform underwent a total expansion of 20% starting from a diameter of 1.498 inches to a diameter of 1.800 inches.

Figure 24:
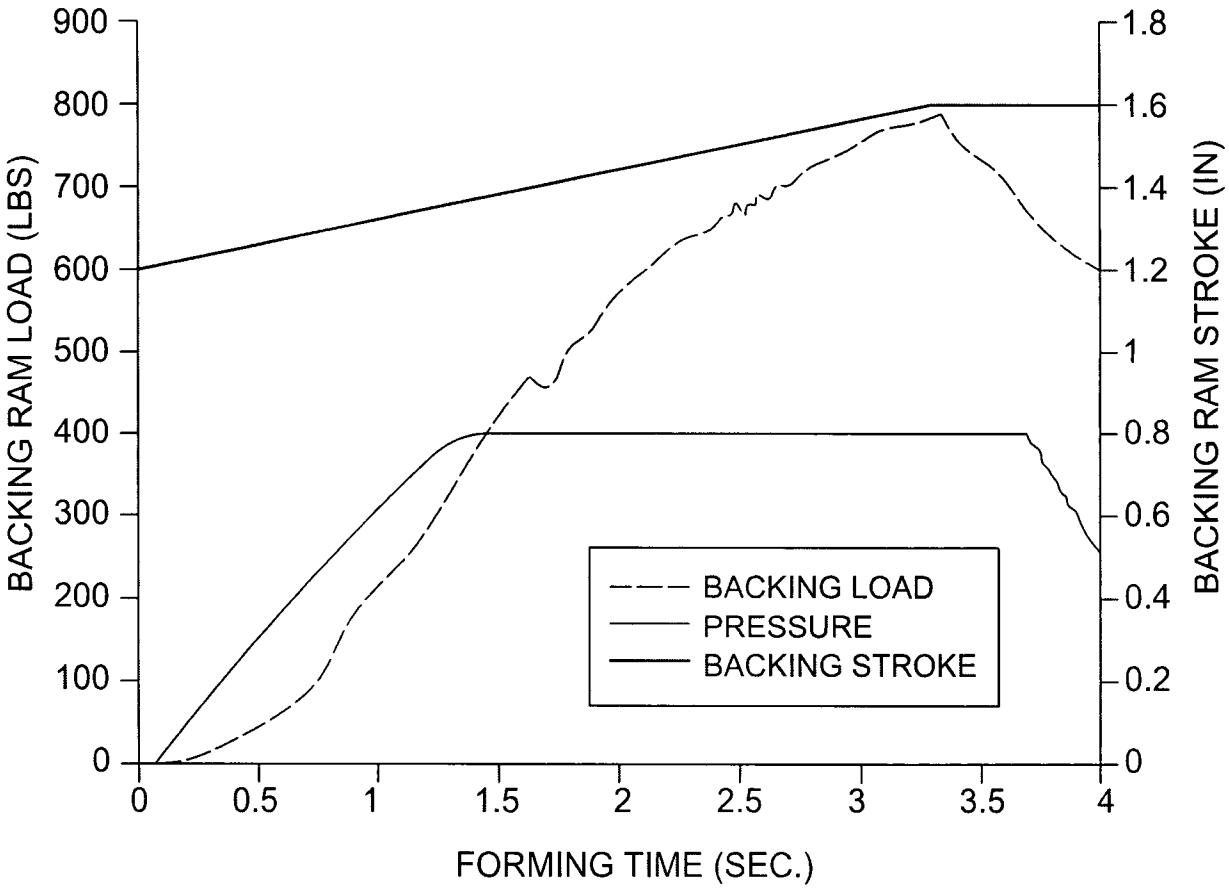
FIG. 24 is a graph of machine output data showing forming conditions (forming pressure, backing ram motion and backing load machine output data) for a typical PRF forming operation in the practice of the present method.

The forming pressure, backing ram motion and backing load machine output data have been plotted in FIG. 24.

FIGS. 23A, 23B, 23C and 23D are computer model results and illustrate the progressive expansion of a preform having a wall thickness gradient in accordance with the invention, during performance of a pressure-ram-forming method embodying the invention, based on finite element analysis (FEA). As there shown, before subjection to internal fluid pressure (FIG. 18A) the preform 318 has a generally cylindrical side wall 319 spaced uniformly from the die cavity wall 411, while the punch 412 at the lower end of the die rests against the closed end 320 of the preform. At the onset of internal pressurization of the preform, the thinnest region of the side wall, adjacent the open upper end of the preform, expands outwardly against the die cavity wall (FIG. 23B).

As internal pressurization increases, the outward expansion of the preform proceeds downwardly to a region of greater wall thickness (FIG. 23C). The punch 412 moves upwardly against the preform lower end 320 to shape the base of the produced container (FIG. 23D), and the preform side wall uniformly engages the die cavity wall throughout its length.

That is to say, as shown in FIGS. 23A, 23B, 23C and 23D, the tapered wall preform expansion starts at the upper thin portion of the preform (FIGS. 23A and B) due to the local onset of bulging under the combination of the side wall thickness distribution and pressurization. As the pressure increases, this expansion propagates from the top to the base of preform and finally the ram motion completes the container shape (FIGS. 23C and D).

Although the wall gauge of the final container is thinner than that of the preform from which it is made, the wall thickness gradient tends to be preserved in PRF methods embodying the invention, especially in straight-walled containers. A stronger, thicker container bottom portion is desirable to help the domed bottom resist internal pressures as from a contained aerosol product, while a thinner top portion facilitates forming into a flange or curl for a closure.

Thus, stated broadly, the method of the present invention involves pressure-ram-forming a preform having a wall thickness gradient such that the wall thickness decreases progressively from the closed end to the open end of the preform, e.g. using any of the PRF procedures described above and represented in FIGS. 1-13.

In summary, in accordance with particular embodiments of the invention, a thickness gradient is created in the wall of a preform by ironing with a tapered punch so that the wall becomes progressively thinner toward the open end. When the preform is subjected to internal fluid pressure in a PRF die, expansion starts at the top and moves down toward the base. This is essentially the same effect as is achieved by in-die heating of a preform of constant wall thickness to induce a top-to-bottom temperature gradient, but without the problems of adverse effect (on temperature gradients) of variables such as production speed, preform size and tooling set up. Progressive expansion prevents blow-outs by allowing the bottom ram punch to move up and form the base, before or after the lower part of the container comes into contact with the die.

It is to be understood that the invention is not limited to the procedures and embodiments hereinabove specifically set forth but may be carried out in other ways without departure from its spirit.

What is claimed is:

1. A method of forming a metal container of defined shape and lateral dimensions, comprising (a) disposing a hollow metal preform having a wall, a closed end and an open end in a die cavity laterally enclosed by a die wall defining said shape and lateral dimensions, with a punch located at one end of the cavity and translatable into the cavity, the preform closed end being positioned in proximate facing relation to the punch and at least a portion of the preform being initially spaced inwardly from the die wall;

(b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity; and (c) translating the punch into the cavity to engage and displace the closed end of the preform in a direction opposite to the direction of force exerted by fluid pressure thereon, deforming the closed end of the preform, wherein the preform, as disposed in the die cavity before it is subjected to the internal fluid pressure, has a wall thickness gradient such that the preform wall thickness decreases progressively from said closed end toward said open end and such that outward expansion of the preform begins at the open end and progresses sequentially from the open end to the closed end.

2. A method according to claim 1, wherein the punch is moved into the cavity after the preform begins to expand but before expansion of the preform is complete in step (b).

3. A method according to claim 1, wherein the punch is moved into contact with the closed end of the preform before commencing expansion of the preform and the contact is maintained throughout the expansion of the preform.

4. A method according to claim 1, wherein said punch has a contoured surface, the closed end of the preform being deformed so as to conform to said contoured surface.

5. A method according to claim 4, wherein said punch has a domed contour, and wherein step (c) deforms said closed end of said preform into said domed contour.

6. A method according to claim 1, wherein said defined shape is a bottle shape including a neck portion and a body portion larger in lateral dimensions than the neck portion, said die cavity having a long axis, said preform having a long axis and being disposed substantially coaxially with said cavity in step (a), and said punch being translatable along the long axis of the cavity.

7. A method according to claim 6, wherein said preform is an elongated and initially generally cylindrical workpiece having said open end opposite said closed end and is substantially equal in diameter to said neck portion of said bottle shape.

8. A method according to claim 6, wherein said preform is an elongated and initially generally cylindrical workpiece having an open end opposite said closed end and is larger in diameter than said neck portion of said bottle shape; and including a further step of subjecting the workpiece, adjacent said open end, to a spin forming operation to form a neck portion of reduced diameter, after performance of steps (a), (b) and (c).

9. A method according to claim 6 wherein the neck portion of the defined shape includes a screw thread or lug for securing a screw closure to the formed container and wherein the die wall has a neck portion with a thread or lug formed therein for imparting a thread to the preform during performance of step (b).

10. A method according to claim 6 wherein the neck portion of the defined shape includes a neck ring and wherein the die wall has a neck portion with a relief feature formed therein for imparting a neck ring to the preform during performance of step (b).

11. A method according to claim 1, wherein said die wall comprises a split die separable for removal of the formed container following step (c).

12. A method according to claim 11, wherein said defined shape is asymmetric about said long axis of said cavity.

13. A method according to claim 1, wherein said punch is initially positioned, at the start of step (b), to limit axial lengthening of the preform by said fluid pressure.

14. A method according to claim 1, wherein step (c) is initiated at substantially the same time that said portion of the preform begins to come into contact with the die wall.

15. A method according to claim 1, wherein said workpiece has sufficient formability to be expandable to said defined shape in a single pressure forming operation.

16. A method according to claim 1, including a preliminary steps of placing the workpiece in a die cavity smaller than the first-mentioned die cavity and subjecting the workpiece therein to internal fluid pressure to expand the workpiece to an intermediate size and shape smaller than said defined shape and lateral dimensions, before performing steps (a), (b) and (c).

17. A method according to claim 1, wherein said preform is an aluminum preform.

18. A method according to claim 1, wherein, during step (b), fluid pressure within the preform occurs in successive stages of (i) rising to a first peak before expansion of the preform begins, (ii) dropping to a minimum value as expansion commences, (iii) rising gradually to an intermediate value as expansion proceeds until the preform is in extended though not complete contact with the die wall, and (iv) rising from the intermediate value during completion of preform expansion; and wherein initiation of translation of the punch in step (c) to displace and deform the closed end of the preform occurs substantially at the end of stage (iii).

19. A method according to claim 1, wherein, during step (b), the closed end of the preform assumes an enlarged and generally hemispherical configuration as said portion of the preform comes into initial contact with the die wall in step (b); and wherein initiation of translation of the punch in step (c) to displace and deform the closed end of the preform occurs substantially at the time that the preform closed end assumes said configuration.

20. A method according to claim 1, wherein step (b) comprises simultaneously applying internal positive fluid pressure and external positive fluid pressure to the preform in the cavity, said internal positive fluid pressure being higher than said external positive fluid pressure.

21. A method according to claim 20, including controlling strain rate in the preform by independently controlling the internal and external positive fluid pressures to which the preform is simultaneously subjected for varying the differential between said internal positive fluid pressure and said external positive fluid pressure.

22. A method according to claim 20, wherein said internal and external positive fluid pressures are applied by feeding gas to the interior of the preform and to the die cavity externally of the preform, respectively, through separate channels.

23. A method according to claim 1, wherein the punch is actuated to displace and deform the closed end of the preform substantially at the end of the expansion phase.

24. A method according to claim 1, wherein the die cavity has a second end opposed to said one end and an axis extending therebetween, and wherein the die wall comprises a split die comprising a plurality of split inserts disposed in tandem along said axis for defining successive portions of said shape and separable for removal of the formed container following step (c).

25. A method according to claim 24, wherein said split inserts are removably and replaceably received within a split holder that maintains the inserts in fixed die-cavity-defining position during performance of steps (b) and (c).

26. A method according to claim 25, wherein at least one of said inserts has an inner surface bearing a relief feature for imparting a corresponding relief feature to the container.

27. A method according to claim 25, further comprising the steps of selecting said at least one insert from a group of interchangeable inserts having inner surfaces respectively bearing different relief features, and disposing the selected insert in said holder, before performing step (b).

28. A method according to claim 1, wherein the preform is at an elevated temperature during performance of steps (b) and (c).

29. A method of forming a metal container of defined shape and lateral dimensions, comprising the steps of:

(a) disposing a hollow metal preform having a wall, a closed end and an open end in a die cavity laterally enclosed by a die wall defining said shape and lateral dimensions, the preform closed end being positioned in facing relation to one end of the cavity and at least a portion of the preform being initially spaced inwardly from the die wall, and (b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity, wherein the preform, as disposed in the die cavity before it is subjected to the internal fluid pressure, has a wall thickness gradient such that the preform wall thickness decreases progressively from said closed end toward said open end and such that outward expansion of the preform begins at the open end and progresses sequentially from the open end to the closed end.

30. A method according to claim 29, wherein step (b) comprises simultaneously applying internal positive fluid pressure and external positive fluid pressure to the preform in the cavity, said internal positive fluid pressure being higher than said external positive fluid pressure, and including controlling strain rate in the preform by independently controlling the internal and external positive fluid pressures to which the preform is simultaneously subjected for varying the differential between said internal positive fluid pressure and said external positive fluid pressure.

31. A method according to claim 29, wherein the container is an aluminum container, and further including the step of making the preform from aluminum sheet having a recrystallized or recovered microstructure with a gauge in a range of about 0.25 to about 1.5 mm, prior to performance of step (a).

32. A method according to claim 29, wherein the container is an aluminum container; wherein said defined shape is a bottle shape including a neck portion and a body portion larger in lateral dimensions than the neck portion, said die cavity having a long axis, said preform having a long axis and being disposed substantially coaxially with said cavity in step (a); wherein said preform is an elongated and initially generally cylindrical workpiece having said open end opposite said closed end and is substantially equal in diameter to said neck portion of said bottle shape; and including preliminary steps of placing the workpiece in a die cavity smaller than the first-mentioned die cavity and subjecting the workpiece therein to internal fluid pressure to expand the workpiece to an intermediate size and shape smaller than said defined shape and lateral dimensions, before performing steps (a) and (b).

33. A method of forming a hollow metal article of defined shape and lateral dimensions, comprising (a) disposing a hollow metal preform having a wall, a closed end and an open end in a die cavity laterally enclosed by a die wall defining said shape and lateral dimensions, the preform closed end being positioned in facing relation to one end of the cavity and at least a portion of the preform being initially spaced inwardly from the die wall; and (b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity;

wherein the preform, as disposed in the die cavity before it is subjected to the internal fluid pressure, has a wall thickness gradient such that the preform wall thickness decreases progressively from said closed end toward said open end and such that outward expansion of the preform begins at the open end and progresses sequentially from the open end to the closed end.

34. A method according to claim 33, wherein step (b) comprises simultaneously applying internal positive fluid pressure and external positive fluid pressure to the preform in the cavity, said internal positive fluid pressure being higher than said external positive fluid pressure, and including controlling strain rate in the preform by independently controlling the internal and external positive fluid pressures to which the preform is simultaneously subjected for varying the differential between said internal positive fluid pressure and said external positive fluid pressure.

35. A method according to claim 33, further including the step of making the preform from aluminum sheet having a recrystallized or recovered microstructure with a gauge in a range of about 0.25 to about 1.5 mm, prior to performance of step (a).

36. A method according to claim 33, wherein the article is a hollow aluminum article; wherein said defined shape is a bottle shape including a neck portion and a body portion larger in lateral dimensions than the neck portion, said die cavity having a long axis, said preform having a long axis and being disposed substantially coaxially with said cavity in step (a); wherein said preform is an elongated and initially generally cylindrical workpiece having said open end opposite said closed end and is substantially equal in diameter to said neck portion of said bottle shape; and including preliminary steps of placing the workpiece in a die cavity smaller than the first-mentioned die cavity and subjecting the workpiece therein to internal fluid pressure to expand the workpiece to an intermediate size and shape smaller than said defined shape and lateral dimensions, before performing steps (a) and (b).

37. A method of forming a metal container of defined shape and lateral dimensions, comprising (a) providing a hollow metal preform having a wall, a closed end and an open end and a wall thickness gradient such that the preform wall thickness decreases progressively from said closed end toward said open end;

(b) disposing said hollow metal preform in a die cavity laterally enclosed by a die wall defining said shape and lateral dimensions, with a punch located at one end of the cavity and translatable into the cavity, the preform closed end being positioned in proximate facing relation to the punch and at least a portion of the preform being initially spaced inwardly from the die wall;

(c) subjecting the preform to internal fluid pressure to expand the preform outwardly into substantially full contact with the die wall, the expansion of the preform beginning at the open end and progressing sequentially from the open end to the closed end, thereby to impart said defined shape and lateral dimensions to the preform, said fluid pressure exerting force, on said closed end, directed toward said one end of the cavity; and (d) translating the punch into the cavity to engage and displace the closed end of the preform in a direction opposite to the direction of force exerted by fluid pressure thereon, deforming the closed end of the preform.

38. A method according to claim 37, wherein step (a) comprises drawing and ironing a sheet metal blank, with ironing performed using a tapered punch that causes the preform wall to become progressively thinner toward said open end.

39. A method according to claim 38, wherein the preform is made from aluminum sheet having a recrystallized or recovered microstructure.

40. A method according to claim 38, wherein said preform is produced as a closed end cylinder.

* * * * *